US007766659B2

(12) United States Patent
Otsu et al.

(10) Patent No.: US 7,766,659 B2
(45) Date of Patent: Aug. 3, 2010

(54) SERIES UNIT WITH MOVEABLE TERMINAL(S) FOR CONNECTION OF COAXIAL CABLES

(75) Inventors: Masahiro Otsu, Nisshin (JP); Hozumi Takeda, Nisshin (JP); Tsuneyuki Inayoshi, Nisshin (JP); Akira Hayakawa, Nisshin (JP)

(73) Assignee: Masprodenkoh Kabushikikaisha, Aichi (JP)

( * ) Notice: Subject to any disclaimer, the term of this patent is extended or adjusted under 35 U.S.C. 154(b) by 0 days.

(21) Appl. No.: 12/301,253

(22) PCT Filed: May 18, 2007

(86) PCT No.: PCT/JP2007/060266

§ 371 (c)(1),
(2), (4) Date: Nov. 18, 2008

(87) PCT Pub. No.: WO2007/136008

PCT Pub. Date: Nov. 29, 2007

(65) Prior Publication Data

US 2009/0186491 A1 Jul. 23, 2009

(30) Foreign Application Priority Data

May 18, 2006 (JP) ..... 2006-139333
Sep. 8, 2006 (JP) ..... 2006-244152

(51) Int. Cl.
*H01R 39/00* (2006.01)

(52) U.S. Cl. ..... 439/11; 439/13; 439/20

(58) Field of Classification Search ..... 439/11, 439/20–26, 63, 13
See application file for complete search history.

(56) References Cited

U.S. PATENT DOCUMENTS 4,850,880 A * 7/1989 Zayat et al. ..... 439/11

(Continued)

FOREIGN PATENT DOCUMENTS

JP 4-249077 B2 9/1992

(Continued)

OTHER PUBLICATIONS

International Preliminary Report on Patentability (Form PCT/IB/373) including translated Written Opinion (Form PCT/ISA/237) for International Patent Application No. PCT/JP2007/060266 (Dec. 10, 2008).

(Continued)

*Primary Examiner*—Michael C Zarroli
(74) *Attorney, Agent, or Firm*—Vincent K. Gustafson; Intellectual Property Technology Law

(57) ABSTRACT

A series unit comprises an input terminal and an output terminal each composed of a tubular receptacle having a center conductor and an external conductor provided concentrically with the center conductor, a television terminal, and a unit case for supporting the input terminal, the output terminal, and the television terminal. The external conductors of the terminals are electrically interconnected through the unit case. The center conductors are electrically interconnected in the space defined inside the unit case. The orientation of the connection end portion of the unit case is perpendicular to the connection/disconnection end portion to/from which the terminal of the cable is connected/disconnected. The input terminal and the output terminal are constituted as movable terminals rotatable at the connection end portions of the unit case. The planes defined by the center axes of the connection/disconnection end portions by the rotation of the movable terminals are perpendicular to each other.

23 Claims, 16 Drawing Sheets

U.S. PATENT DOCUMENTS

| | | | | |
|---|---|---|---|---|
| 6,287,144 | B1 | 9/2001 | Baffert | |
| 7,374,427 | B2 | 6/2008 | Kodaira | |
| 7,577,983 | B2 * | 8/2009 | Shapson | 725/149 |

FOREIGN PATENT DOCUMENTS

| | | | |
|---|---|---|---|
| JP | 3039950 | U | 5/1997 |
| JP | 2000-173730 | A | 6/2000 |
| JP | 2004-247228 | A | 9/2004 |
| JP | 2005-222804 | A | 8/2005 |

OTHER PUBLICATIONS

Notification of Transmittal of Copies of Translation of the International Preliminary Report on Patentability for International Patent Application No. PCT/JP2007/060266 (Form PCT/IB1338) (Jan. 16, 2009).

* cited by examiner

SERIES UNIT WITH MOVEABLE TERMINAL(S) FOR CONNECTION OF COAXIAL CABLES

CROSS-REFERENCE TO RELATED APPLICATIONS

This application is a U.S. national phase entry under the provisions of 35 U.S.C. §371 of International Application No. PCT/JP07/60266 filed May 18, 2007, which in turn claims priority of Japanese Patent Application No. 2006-139333 filed May 18, 2006. The disclosures of such international application and Japanese priority application are hereby incorporated herein by reference in their respective entireties, for all purposes.

TECHNICAL FIELD

The present invention relates to a series unit used for a television reception system. Particularly, the present invention relates to a structure of a series unit having a good efficiency in renewing an existing series unit.

BACKGROUND ART

Conventionally, a type of series unit, which is so called direct-mounted type, has been known wherein a coaxial receptacle is used as an outlet terminal (also called a television terminal), and wherein coaxial cables whose distal ends are processed into predetermined sizes are directly connected as an input terminal and an output terminal (see, for example, Patent Document 1).

In recent years, a series unit is required to have a very wide frequency characteristic, since a series unit needs to allow the passage of signals in the intermediate frequency band, which are outputted from a satellite converter, in order to receive not only terrestrial broadcast, but also satellite broadcast. Therefore, a series unit, in which coaxial receptacles having high frequency characteristics and shielding properties are used for the input terminal and the output terminal in addition to the outlet terminal, is widely used.

The coaxial receptacle type of series unit is generally configured such that the receptacle for the outlet terminal is disposed on the front surface (on the surface to be disposed along a wall surface of a room) of a housing, formed approximately into a rectangular parallelepiped shape, and that at least one junction is disposed on the flat bottom surface of the housing (for example, see Patent Document 2).

Patent Document 1: Japanese Patent No. 3066542

Patent Document 2: Unexamined Japanese Patent Publication No. 2000-173730

DISCLOSURE OF THE INVENTION

Problems to be Solved by the Invention

In the current situation, digital terrestrial broadcasting using the UHF band has been started, and analog terrestrial broadcasting is ending in 2011. In an attempt to receive the digital terrestrial broadcasting, by using a reception system constituted with the conventional direct-mounted type of series unit, some problems are likely to be caused: external electric wave interference enters from the directly mounted portion of the series unit, wherein the shielding property is low, which causes block-noise that is particular in digital broadcast, or cuts off the screen image in some cases.

By replacing the direct-mounted type of series unit with a series unit, having a high frequency characteristic and a good shielding property (a good immunity characteristic) as disclosed in the above-described Patent Document 2, digital terrestrial broadcast can be provided with clear screen image without any interference.

As mentioned in the conventional examples, a series unit is generally attached in an outlet box or a switch box disposed on a wall surface, and having a very limited storage space in terms of the front width and the depth. Therefore, coaxial cables, introduced inside of a wall, cannot be stored in order to keep extra lengths thereof in a switch box and the like. Coaxial cables are disposed in suitable lengths for attaching a direct-mounted type of series unit. That is, the coaxial cables introduced in the switch box cannot be further extended, and the lead-in positions and the directions cannot be adjusted.

When a direct-mounted type of series unit is replaced with a coaxial receptacle type of series unit, F-type coaxial cable connectors, which enable a connection to coaxial receptacles, need to be attached to distal ends of coaxial cables disengaged from the direct-mounted type of series unit.

In this case, the distal end portions of the coaxial cables, previously connected directly to the series unit, are cut off by a nipper and the like, and then predetermined lengths of the distal end portions are processed for attaching the above-described F-type coaxial cable connectors. Consequently, the coaxial cables, having the connector attached thereto, become even shorter and there isn't much extra length.

Therefore, there have been some problems depending on the wiring state of existing coaxial cables: even if the series unit is replaced to the coaxial receptacle type, coaxial cables cannot be connected; even if the coaxial cables can be connected, coaxial cables cannot be stored in a switch box and the like; and even if the connection and the storing of the coaxial cables are successfully done, the installation work requires time and effort.

The present invention is made so as to solve the above-described and other problems. One of the objects of the invention is to provide a series unit that can be efficiently attached to a wall surface.

Another object of the invention is to provide a series unit that is suitable for a replacement of an existing direct-mounted type of series unit.

Another object of the invention is to provide a series unit that can be efficiently installed in place of an existing direct-mounted type of series unit.

Means for Solving the Problem

In order to solve the above-described problems the invention in the first aspect provides a series unit including an input terminal, an output terminal, a television terminal, and a unit case. Each of the input terminal, the output terminal, and the television terminal is constituted with a tubular receptacle having a center conductor and an external conductor provided concentrically with the center conductor. The unit case supports the input terminal, the output terminal and the television terminal. The external conductors of the terminals are electrically interconnected through the unit case. The center conductors of the terminals are electrically interconnected in a space formed inside of the unit case. Both of the input terminal and the output terminal have a shape in which a direction of a connection end portion, connected to the unit case, and a direction of a connection/disconnection end portion, to/from which a terminal of a cable is connected/disconnected, are perpendicular to each other. Both of the input terminal and the output terminal are constituted as movable terminals so as to be rotatable at the connection end portions connected to the unit case, and are disposed such that planes defined by central axes of the connection/disconnection end portions by rotation of the movable terminals intersect with each other.

The second aspect of the invention provides the series unit according to the first aspect, wherein one of the movable terminals is disposed such that the plane, defined by the central axis of the connection/disconnection end portion by rotation of the one of the movable terminals, is perpendicular to a central axis of the television terminal.

The third aspect of the invention provides a series unit including an input terminal, an output terminal, a television terminal, and a unit case. Each of the input terminal, the output terminal, and the television terminal is constituted with a tubular receptacle having a center conductor and an external conductor provided concentrically with the center conductor. The unit case supports the input terminal, the output terminal and the television terminal. The external conductors of the terminals are electrically interconnected through the unit case. The center conductors of the terminals are electrically interconnected in a space formed inside of the unit case. At least one of the input terminal and the output terminal has a shape in which a direction of a connection end portion, connected to the unit case, and a direction of a connection/disconnection end portion, to/from which a terminal of a cable is connected/disconnected, are perpendicular to each other. The at least one of the input terminal and the output terminal is constituted as a movable terminal so as to be rotatable at the connection end portion connected to the unit case, and is disposed such that a plane defined by a central axis of the connection/disconnection end portion by rotation of the movable terminal is perpendicular to a central axis of the television terminal.

The forth aspect of the invention provides the series unit according to any of the first to the third aspects, wherein the unit case includes a first case portion and a second case portion. The first case portion has a front surface to which the television terminal is provided. The second case portion is provided to a portion on a rear surface of the first case portion so as to extend therefrom, and has an internal space connected to a space formed inside of the first case portion. One of the input terminal and the output terminal is disposed on the rear surface of the first case portion, and another is disposed on a lateral surface of the second case portion extending from the rear surface of the first case portion.

The fifth aspect of the invention provides a series unit including an input terminal, a television terminal, and a unit case. Each of the input terminal and the television terminal is constituted with a tubular receptacle having a center conductor and an external conductor provided concentrically with the center conductor. The unit case supports the input terminal and the television terminal. The external conductors of the terminals are electrically interconnected through the unit case. The center conductors of the terminals are electrically interconnected in a space formed inside of the unit case. The input terminal has a shape in which a direction of a connection end portion, connected to the unit case, and a direction of a connection/disconnection end portion, to/from which a terminal of a cable is connected/disconnected, are perpendicular to each other. The input terminal is constituted as a movable terminal so as to be rotatable at the connection end portion connected to the unit case, and is disposed such that a plane defined by a central axis of the connection/disconnection end portion by rotation of the movable terminal is perpendicular to a central axis of the television terminal.

The sixth aspect of the invention provides the series unit according to any of the first to the fifth aspects wherein a rotational range of the movable terminal is larger than 180°.

The seventh aspect of the invention provides the series unit according to any of the first to the sixth aspects including, instead of the input terminal, a two-pronged terminal having a connection end portion and a pair of connection/disconnection end portions. The connection end portion is connected to the unit case. Terminals of cables are connected/disconnected to/from the pair of connection/disconnection end portions. One of the connection/disconnection end portions is used for input and another is used for output.

The eighth aspect of the invention provides the series unit according to any of the first to the seventh aspects wherein the connection/disconnection end portion of the movable terminal is constituted with an F-type connector which allows a connection of an F-type plug, connected to a distal end of a coaxial cable.

The ninth aspect of the invention provides the series unit according to any of the first to the eighth aspects wherein the connection end portion of the movable terminal is rotatably attached to an attachment hole, formed on the unit case, and configured such that the external conductor maintains electrical connection with the unit case, and that the movable terminal is rotated on a central axis of the connection end portion as a rotational axis.

The tenth aspect of the invention provides the series unit according to the ninth aspect wherein the unit case is constituted with a pair of divided cases by integrally securing the pair of divided cases. Each of the pair of divided cases is formed so as to have a half of the attachment hole thereon. Moreover, one of an outer peripheral surface of the connection end portion of the movable terminal and an attachment hole forming fringe, forming the attachment hole of the divided cases, is provided with a groove portion, and another is provided with a convex portion, engaged with the groove portion, as a terminal-side connection device and a case-side connection device. Furthermore, the movable terminal is rotatably attached to the unit case by sandwiching the terminal-side connection device with the case-side connection device provided to each of the pair of divided cases.

The eleventh aspect of the invention provides the series unit according to the ninth aspect wherein the connection end portion of the movable terminal includes an insertion portion, a flange portion, and a groove portion. The insertion portion is adopted to be inserted through the attachment hole. The flange portion is formed so as to have a diameter larger than a diameter of the attachment hole. The groove portion is formed in a position on an outer peripheral surface of the insertion portion, and in a position away from the flange portion for, at least, as long as a thickness of a portion of a wall surface of the unit case where the attachment hole is formed. Moreover, the movable terminal is rotatably attached to the unit case by securing a stopper piece, having a diameter larger than the diameter of the attachment hole, while the insertion portion is inserted through the attachment hole.

The twelfth aspect of the invention provides the series unit according to any of the first to the eleventh aspects wherein a washer is inserted between the movable terminal and the unit case.

ADVANTAGEOUS EFFECT OF THE INVENTION

In the present invention, both of the input terminal and the output terminal are configured as movable terminals that can be rotated, and configured such that the rotational surfaces of the both terminals are differently defined from each other.

Therefore, even if there isn't any extra length available in the lead-in wires, introduced into a switch box or an outlet box attached to a wall surface, the lead-in wires can be disposed via the almost shortest way by rotating the movable terminals.

That is, the lengths of existing lead-in wires and the disposition directions thereof do not restrict the installation work. Connection work can be easily done even in an extremely limited space, such as the inside of a switch box and the like, which can, in turn, shorten the work time.

Lead-in wires introduced into a switch box or an outlet box are generally disposed along a surface perpendicular to the central axis of a television terminal. Therefore, by disposing one of the movable terminals in such a manner that the plane, defined by the central axis of the connection/disconnection end portion by the rotation of the movable terminal, is perpendicular to the central axis of the television terminal, the efficiency in the connection work can be more reliably improved.

Not both of the input terminal and the output terminal have to be configured as movable terminals. At least one of the terminals may be configured as a movable terminal, and may be disposed in such a manner that the plane, defined by the central axis of the connection/disconnection end portion by the rotation of the movable terminal, is perpendicular to the central axis of the television terminal.

As described above, in a state wherein lead-in wires are disposed along the surface perpendicular to the central axis of the television terminal, such configuration is also sufficient to improve the efficiency of the connection work.

In this case, the input terminal may be configured as a movable terminal, and the output terminal may be omitted.

Moreover, by defining the rotational range of the movable terminal larger than 180°, installation work can be more suitably performed in various dispositional states of lead-in wires.

Furthermore, by providing the two-pronged terminal, instead of the input terminal, various types of reception systems can be more flexibly accommodated.

BRIEF DESCRIPTION OF THE DRAWINGS

FIG. 1A is a rear view, FIG. 1B is a front view, FIG. 1C is a side view, and FIG. 1D is a top view thereof;

FIG. 6A is a rear view, FIG. 6B is a front view, FIG. 6C is a side view, and FIG. 6D is a top view thereof;

FIG. 7A is a rear view, FIG. 7B is a front view, FIG. 7C is a side view, and FIG. 7D is a top view thereof;

FIG. 8A is a rear view, FIG. 8B is a front view, FIG. 8C is a side view, and FIG. 8D is a top view thereof;

FIG. 9A is a sectional view which corresponds to the view along the line IIIA-IIIA in FIG. 1A, FIG. 9B is a schematic view illustrating a slide member, and FIG. 9C is a perspective view showing two of the slide members put together;

EXPLANATION OF REFERENTIAL NUMERALS

1, 1A-1F . . . series unit, 3, 103, 203 . . . unit case, 3*a*, 103*a*, 203*a* . . . first case portion, 3*b*, 103*b*, 203*b* . . . second case portion, 5, 105 . . . input terminal, 6, 106 . . . television terminal, 7 . . . terminal block, 8, 108 . . . output terminal, 9, 11, 17, 111 . . . center conductor, 12, 112 . . . external conductor, 13, 18, 113, 118 . . . insulator, 14 . . . cover, 15, 115 . . . connection/disconnection end portion, 16, 116 . . . connection end portion, 20, 120 . . . terminal-side connection device, 21 . . . projecting portion, 22, 122 . . . groove portion, 30 . . . case-side connection device, 30*a* . . . concave portion, 30*b* . . . ring-shaped wall, 31 . . . upper case, 32 . . . lower case, 33 . . . front wall, 34 . . . screw hole, 35 . . . through hole, 36 . . . screw rod, 38 . . . projection piece, 40 . . . slide member, 50, 150, 155 . . . printed-wiring board, 54 . . . fixing claw, 55 . . . connection terminal, 56 . . . base body, 57 . . . contact piece, 57*a* . . . urging piece, 57*b* . . . slide retention portion, 57*c* . . . receiving portion, 71 . . . hole, 73 . . . locking portion, 95 . . . two-pronged terminal, 121 . . . flange portion, 130 . . . attachment hole, 131, 231 . . . box-like case, 132, 232, 233 . . . cover, 140 . . . disc spring washer, 153 . . . connection pin.

DETAILED DESCRIPTION OF PREFERRED EMBODIMENTS OF THE INVENTION

The following describes embodiments of the present invention in a detailed manner based on the drawings.

First Embodiment

Overall Structure

Figure 1A:
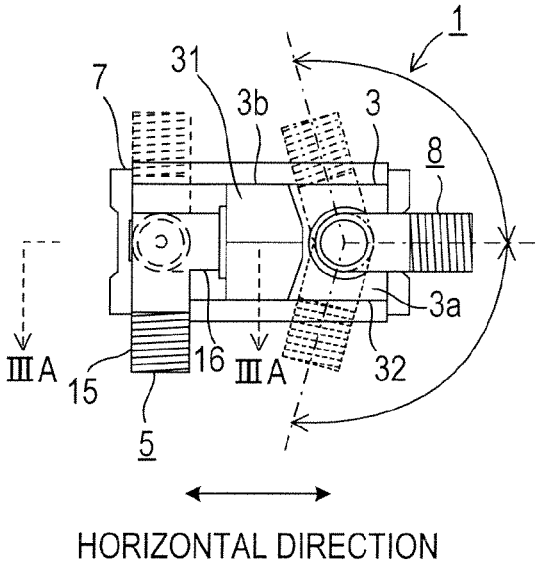
FIGS. 1A-1D are schematic views showing a series unit according to a first embodiment of the present invention.
Figure 1C:
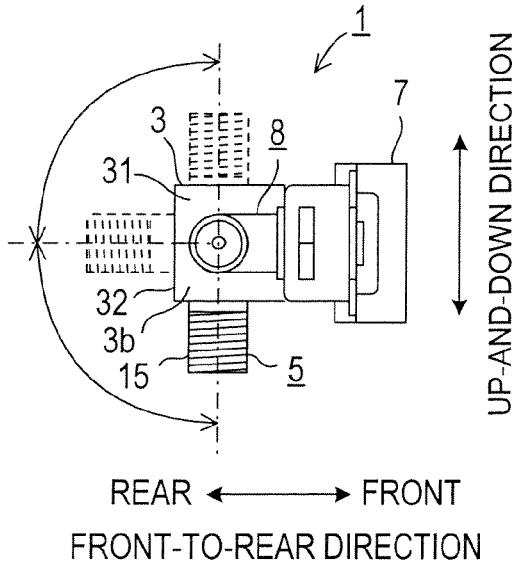
Figure 1B:
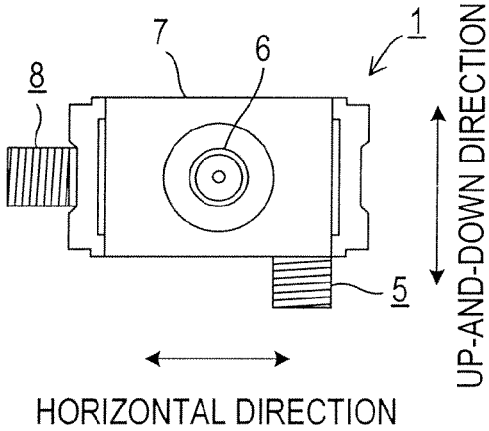
Figure 1D:
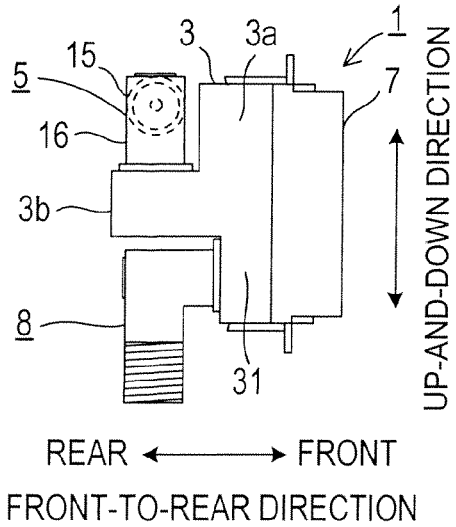

FIGS. 1A-1D are schematic views showing a series unit according to the present invention; FIG. 1A is a rear view, FIG. 1B is a front view, FIG. 1C is a side view, and FIG. 1D is a top view thereof. It is to be noted that, in the following description, directions are referred, unless specifically noted, based on the state shown in FIG. 1B. The side facing in the direction toward which a television terminal 6 extends is referred to as a front side or a front face. The left-to-right direction in FIG. 1A and FIG. 1B and the up-and-down direction in FIG. 1D are referred to as a horizontal direction. The left-to-right direction in FIG. 1C and FIG. 1D is referred to as a front-to-rear direction. The up-and-down direction in FIG. 1A, FIG. 1B, and FIG. 1C is referred to as an up-and-down direction as indicated in the drawings.

As shown in FIGS. 1A-1D, the series unit 1 includes a unit case 3, an input terminal 5, an output terminal 8, a television terminal 6, and a terminal block 7. The unit case 3 is made of a box-shaped body having a space for storing electronic components and so on. The input terminal 5 is rotatably attached in the rear side of the unit case 3, and formed into an L-shape. Similarly, the output terminal 8 is rotatably attached in the rear side of the unit case 3, and formed into an L-shape. The television terminal 6 is disposed in the front side of the unit case 3. The terminal block 7 is attached in the front side of the unit case 3 in such a manner that the television terminal 6 is exposed, and used so as to secure the series unit 1 to a switch box.

The series unit 1 is configured so as to split signals inputted from the input terminal 5, and to output the signals from the output terminal 8 and the television terminal 6.

<Structure of Terminal Block>

Figure 10:
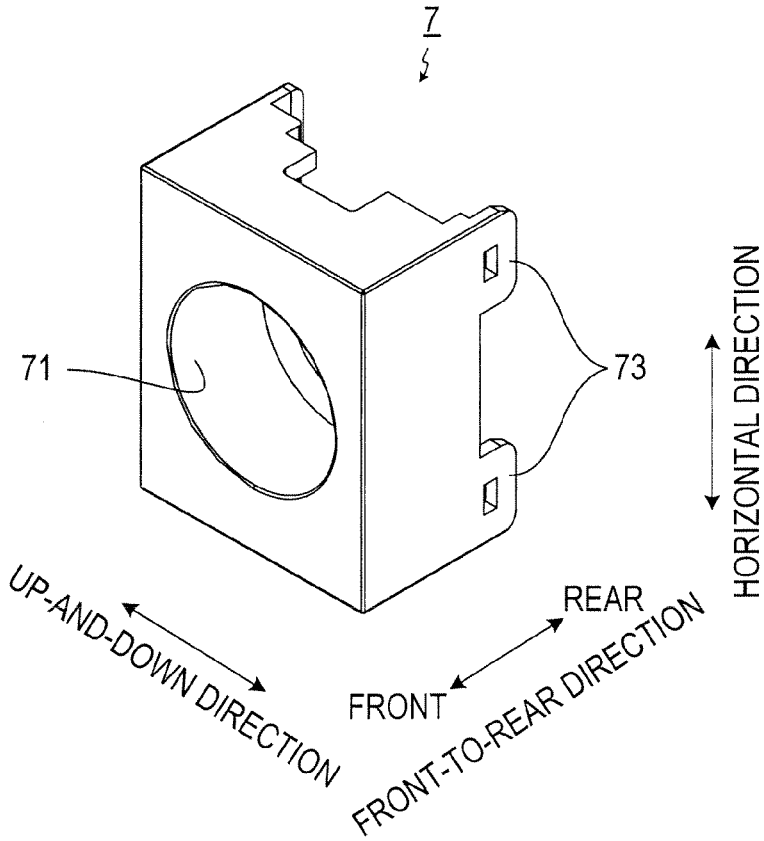
FIG. 10 is a perspective view showing a terminal block.

The terminal block 7 is, as shown in FIG. 10, a known component having a hole 71 through which the television terminal 6 is exposed, and locking portions 73 for securing the series unit to an attachment frame which is to be stored into a switch box. The series unit 1 is stored and secured in a switch box, disposed on a wall or the like, via the attachment frame.

<Structure of Each Terminal>

Figure 2A:
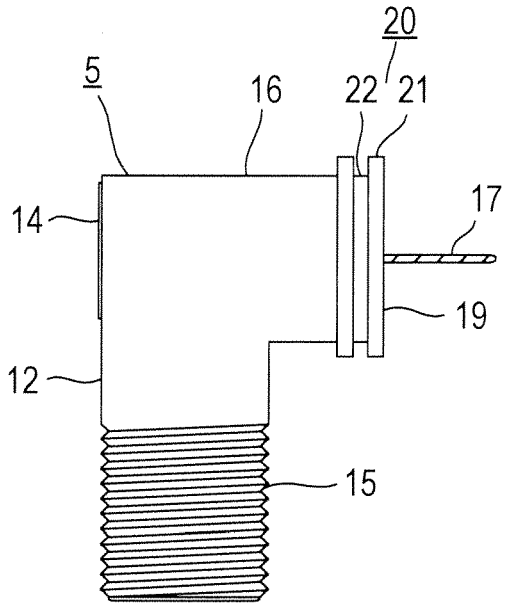
FIG. 2A is a side view showing, in an enlarged manner, an input terminal and an output terminal shown in FIGS. 1A-1D.
Figure 2B:
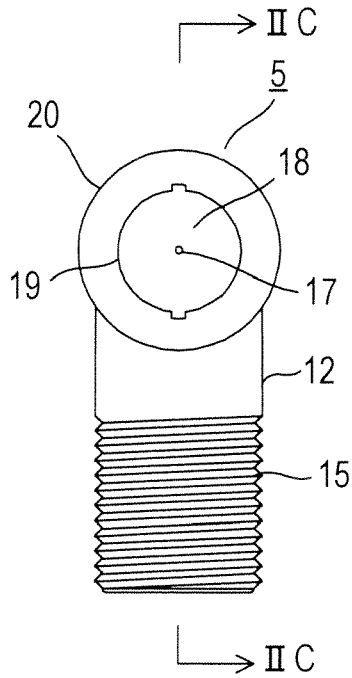
FIG. 2B is a front view.

FIG. 2A is a side view showing, in an enlarged manner, the input terminal 5 and the output terminal 8, which are attached so as to be rotatable with respect to the unit case 3 as a movable terminal. FIG. 2B is a front view, and FIG. 2C is a sectional view thereof along the line IIC-IIC in FIG. 2B.

In order to simplify the description, the following explains about the input terminal 5, but the description of the output terminal 8, which is configured in the same manner, is not repeated.

Figure 2C:
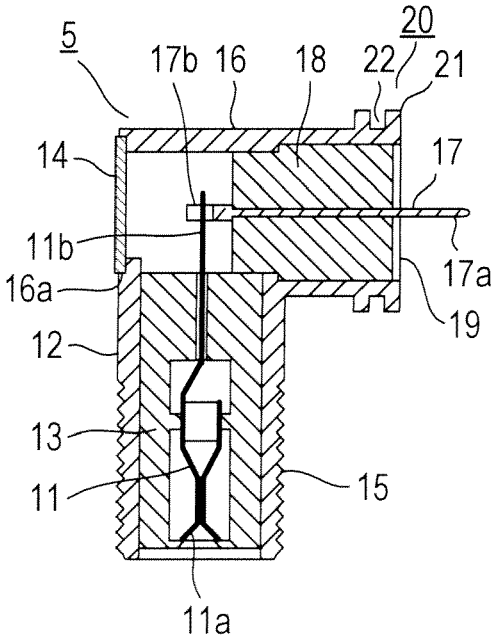
FIG. 2C is a sectional view thereof along the line IIC-IIC in FIG. 2B.

As shown in FIGS. 2A-2C, the input terminal 5 is made of an F-type receptacle having an L shape, and including center conductors 11, 17 and an external conductor 12. The center conductors 11, 17 are connected in an L-shaped manner. The external conductor 12 is disposed concentrically with respect to the center conductors 11, 17 (that is, configured in a cylindrical shape having a circular cross-section).

In the following, between the two portions of the input terminal 5 forming the L-shape, the portion disposed in the side attached to the unit case 3 is referred to as a connection end portion 16, and the portion disposed in the side to/from which an F-type plug is connected/disconnected is referred to as a connection/disconnection end portion 15.

Moreover, the center conductor 1 disposed in the connection/disconnection end portion 15 is referred to a first center conductor. The center conductor 17 disposed in the connection end portion is referred to as a second center conductor. The second center conductor 17 is configured such that a distal end portion 17*a* extends from an opening 19, formed by the external conductor 12 in the connection end portion 16, to outside of the external conductor 12.

The outer peripheral surface of the external conductor 12 in the connection/disconnection end portion 15 is threaded. On the other hand, the connection end portion 16 is provided with a through hole 16*a*, penetrating into the internal space of the external conductor 12, on the end surface disposed in the side where the connection end portion 16 is connected to the connection/disconnection end portion 15. The through hole 16*a* is closed by a cover 14. Moreover, on the outer peripheral surface of the external conductor 12 in the connection end portion 16, a terminal-side connection device 20 is formed so as to be rotatably attached, while maintaining electrical connection with the unit case 3, to a case-side connection device (shown with the numerical reference 30 in FIG. 3A, FIG. 3B), which is formed on the unit case 3 and will be explained later.

The terminal-side connection device 20 is constituted with a pair of projecting portions 21 formed so as to extend along the entire circumference of the distal end portion of the external conductor 12 in the connection end portion 16. A groove portion 22 is formed between the pair of projecting portions 21. It is to be noted that the projecting portions 21 do not have to extend along the entire circumference, as long as the bottom of the groove portion 22 is suitably disposed on a concentric circle of the central axis of the connection end portion 16.

The first center conductor 11 is manufactured by bending a thin metallic plate material. On one end of the first center conductor 11, a receiving portion 11*a*, having a spring elasticity so as to receive a central axis of a coaxial cable, is formed. On the other hand, the second center conductor 17 is made of a contact pin which is formed in a pin-like shape and has an approximately circular cross-sectional surface in, at least, the distal end portion 17*a*.

The center conductors 11, 17 are respectively disposed, due to insulators 13, 18, in the positions where the central axes of the connection/disconnection end portion 15 and the connection end portion 16 are located, and held so as to contact each other at end portions 11*b*, 17*b*, provided in the opposite sides of the receiving portion 11*a* and the distal end portion 17*a*. The insulators 13, 18 are secured and adhered inside the external conductor 12 by known press fitting, adhesive agent, and so on.

The end portions 11*b*, 17*b* of the center conductors 11, 17, contacting each other inside the external conductor 12, are fixed by, for example, welding and the like through the through hole 16*a*. The cover 14 closes the through hole 16*a* without any gap, and is secured by press fitting or screw fitting so that suitable shield property can be maintained.

The television terminal 6 (see FIG. 1B) is constituted with a tubular receptacle, having a center conductor and an external conductor provided concentrically with respect to the center conductor (that is, made into a tubular shape having a circular cross-section). The television terminal 6 is configured in the same manner as the connection/disconnection end portion 15 of the input terminal 5.

<Structure of Unit Case>

The unit case 3 includes, as shown in FIGS. 1A-1D, a first case portion 3*a* and a second case portion 3*b*. The first case portion 3*a* is disposed in the front. The second case portion 3*b* extends rearward from the rear surface of the first case portion 3*a*, and has a size in the horizontal direction shorter than that of the first case portion 3*a*. The first case portion 3*a* and the second case portion 3*b* are configured so as to form a continuous internal space. That is, the unit case 3 is configured such that the cross-section of the surface, which is perpendicular to the up-and-down direction, becomes approximately the shape of a boldfaced letter T.

The input terminal 5 is disposed on one of the lateral surfaces (the left lateral surface in FIG. 1A) of the second case portion 3*b* in the horizontal direction. The input terminal 5 is attached so as to be rotated on the axis along the horizontal direction. The output terminal 8 is disposed in the opposite side of the input terminal 5 across the second case portion 3*b* (in the right side in FIG. 1A) on the rear surface of the first case portion 3*a*. The output terminal 8 is attached so as to be rotated on the axis along the front-to-rear direction.

In other words, the input terminal 5 is disposed such that the plane defined by the central axis of the connection/disconnection end portion 15 by the rotation of the input terminal 5 (to be referred to as the rotational surface of the input terminal 5) is perpendicular to the horizontal direction. The output terminal 8 is disposed such that the plane defined by the central axis of the connection/disconnection end portion by the rotation of the output terminal 8 (to be referred to as the rotational surface of the output terminal 8) is perpendicular to the front-to-rear direction (that is, the direction along the central axis of the television terminal 6).

Moreover, as shown in FIG. 1A, the lateral surface of the second case portion 3*b*, which is disposed in a position so as to abut on the output terminal 8 when the output terminal 8 is rotated, and restricts the rotational range of the output terminal, is inclined such that the rotational range of the output terminal 8 becomes over 180°. In the present embodiment, the rotational angle of the output terminal 8 is determined to be ±110, while the horizontal direction indicates 0°. That is, the output terminal 8 is configured so as to have the rotational range of 220°.

Moreover, the unit case 3 includes an upper case 31 and a lower case 32. The upper case 31 is, as will be explained later, mostly open in the bottom side. The lower case 32 is mostly open in the top side. The unit case 3 is formed by fixing and adhering the upper and the lower halved portions: the upper case 31 and lower case 32. The unit case 3 (that is, the upper case 31 and the lower case 32) is manufactured by molding a conductive material, such as aluminium die-cast.

<Internal Structure of Unit Case>

Figure 3A:
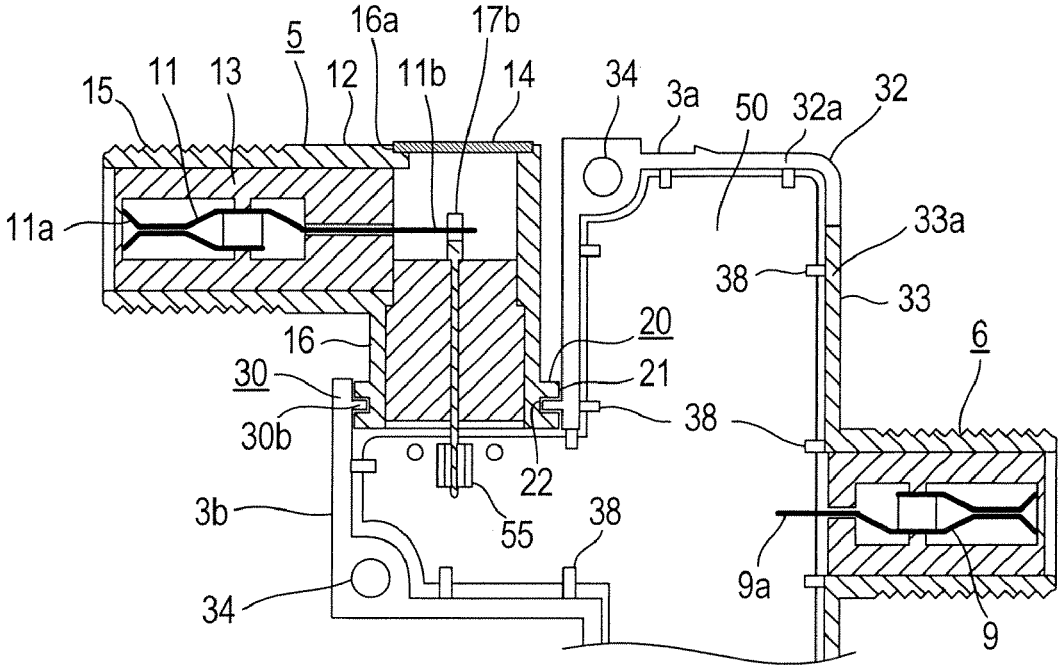
FIG. 3A is a sectional view showing the series unit along the line IIIA-IIIA in FIG. 1A.
Figure 3B:
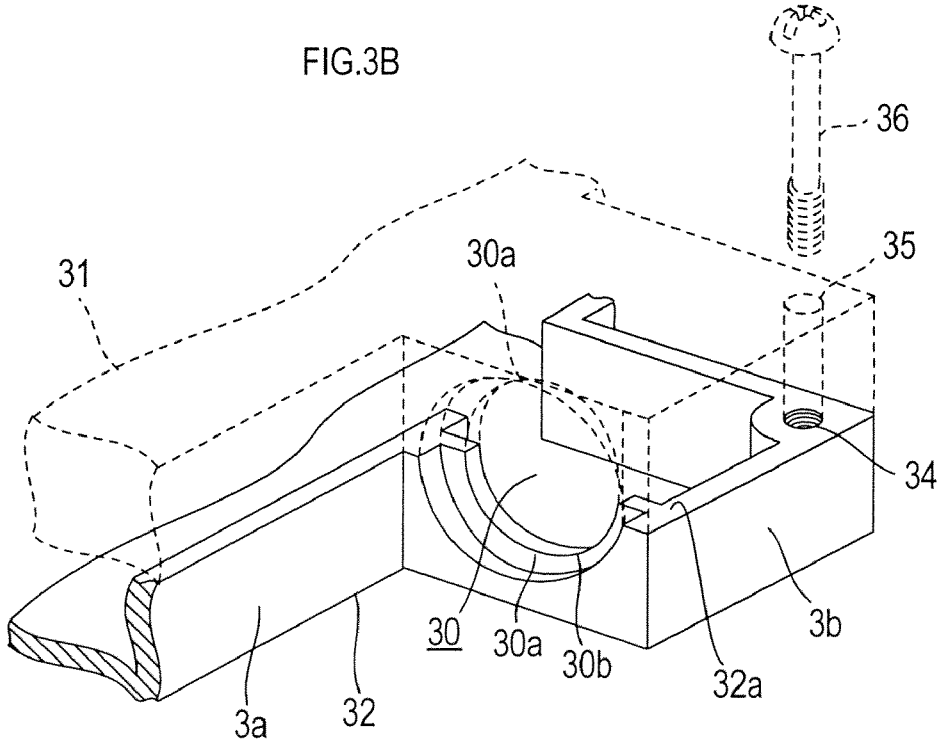
FIG. 3B is a perspective view showing a lower case some portion of which is cut away.

The following describes the internal structure of the unit case 3 with reference to FIG. 3A and FIG. 3B.

The FIG. 3A is a sectional view along the line IIIA-IIIA in FIG. 1A, and shows the lower case 32 in a state in which the upper case 31 is removed, the input terminal 5, and the television terminal 6. FIG. 3B is a perspective view showing the lower case some part of which is cut away. It is to be noted that the outer shapes of the upper case 31 and the lower case 32 are partly simplified in order to make the drawing more understandable.

As shown in FIG. 3A, the lower case 32 is a box-shaped body which is mostly open in the upper side thereof (in the front side in the drawing) and has a space inside. The lower case 32 includes an opening end surface 32*a* which contacts with the upper case 31 when the lower case 32 is combined with the upper case 31.

On a front wall 33 of the lower case 32, a projection, which forms the external conductor of the television terminal 6, is integrally formed. Inside the television terminal 6, the center conductor 9 is held by an insulator such that a distal end portion 9*a* thereof extends to the inside of the case.

In the space formed inside the lower case 32, a printed-wiring board 50, on which electronic components are mounted, is attached. The printed-wiring board 50 is secured to a plurality of projection pieces 38, formed inside the lower case 32, by welding and the like. In other words, electrical conduction between an earth-side conductor, formed on the printed-wiring board 50, and the lower case 32 is obtained via the projection pieces 38. The distal end portion 9*a* of the center conductor 9 of the television terminal 6 is connected to a signal-side conductor, formed on the printed-wiring board 50, by welding and the like.

In a position corresponding to the attachment position for the input terminal 5 on the lateral surface of the second case portion 3*b*, the lower case 32 is provided with a lower concave portion 30*a*, formed as shown in FIG. 3B by cutting the case in a semi-circular shape from the opening end surface 32*a*.

The upper case 31 is also provided with an upper concave portion 30*a* (shown with a dotted line in the drawing) in a position facing the lower concave portion 30*a*. When the upper case 31 and the lower case 32 are combined, the concave portions 30*a* form the case-side connection device 30 constituted with an approximately circular hole. Along the entire circumference of the hole constituting the case-side connection device 30, a ring-shaped wall 30*b*, having a uniform thickness, is formed.

Such case-side connection device 30 is also formed on the rear surface of the first case portion 3*a*, which becomes the attachment position for the output terminal 8.

When the upper case 31 and the lower case 32 are combined and secured, the input terminal 5 is mounted such that the groove portion 22, constituting the terminal-side connection device 20, is engaged with the ring-shaped wall 30*b*, formed along the lower concave portion 30*a* of the lower case 32, which constitutes the case-side connection device 30. Subsequently, by attaching the upper case 31 so that the groove portion 22, constituting the terminal-side connection device 20, is engaged with the ring-shaped wall 30*b*, formed along the upper concave portion 30*a* of the upper case 31, the input terminal 5 is rotatably attached to the unit case 3. The output terminal 8 is also attached in the same manner.

As shown in FIG. 3B, at predetermined positions on the end surface 32*a* of the lower case 32, screw holes 34, each having a female thread formed inside thereof, are formed. Correspondingly, the upper case 31 is provided with through holes 35, which pass through the upper case 31, in the positions facing the screw holes 34.

The upper case 31 and the lower case 32, put together and closed, are integrally secured by threadingly inserting screw rods 36 into the screw holes 34, 35 from the side of the upper case 31.

The following describes the connection between the center conductor 17 of the input terminal 5 (the output terminal 8) and the signal-side conductor formed on the printed-wiring board 50, with reference to the FIGS. 4A-4D.

Figure 4A:
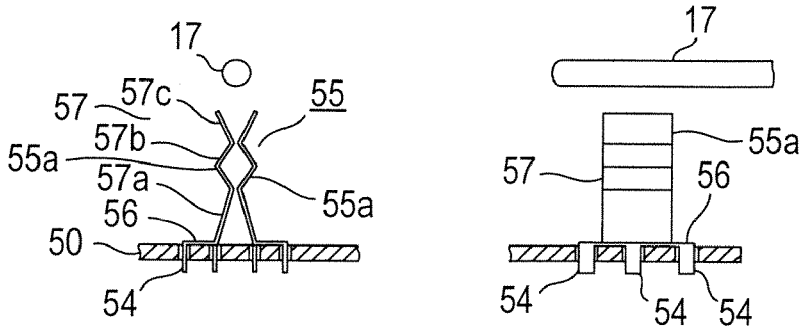
FIGS. 4A-4D are explanatory views showing, in a partially enlarged manner, a connection method so as to introduce each center conductor of an input terminal and an output terminal to a case.
Figure 4B:
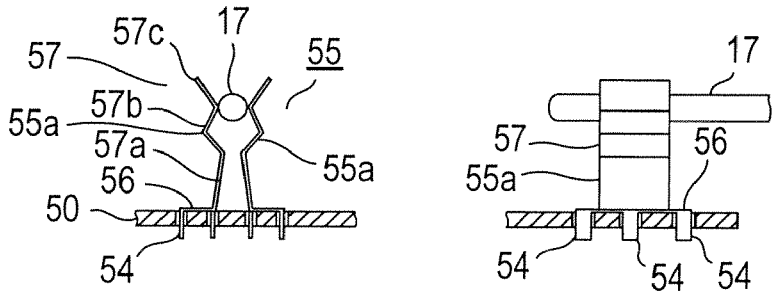
Figure 4C:
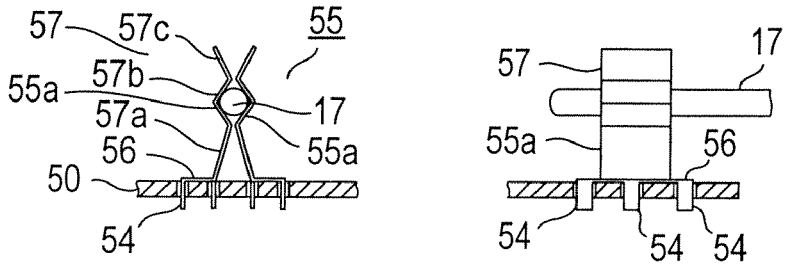
Figure 4D:
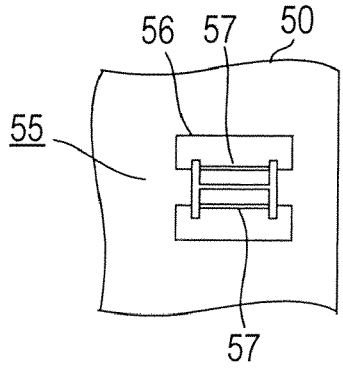

FIGS. 4A-4C are explanatory views showing the structure of a connection terminal 55, which is configured so as to introduce the center conductor 17 of the input terminal 5 (the output terminal 8) into the inside of the case, and illustrating the procedure for connecting the center conductor 17 to the connection terminal 55. FIG. 4D is a plane view showing the connection terminal 55 secured to the printed-wiring board 50 shown in FIGS. 4A-4C from upward.

As shown in FIGS. 4A-4D, the printed-wiring board 50 is provided with the connection terminal 55 facing the position where the input terminal 5 (the output terminal 8) is attached.

The connection terminal 55 is constituted with a pair of connection pieces 55*a*, which is made by bending a thin-plate conductive material having elasticity. Each of the connection pieces 55*a* includes a base body 56 and a contact piece 57. The contact piece 57 is formed by bending the material extending upward from the base body 56 above the printed-wiring board 50. The contact piece 57 includes an urging piece 57*a*, a slide retention portion 57*b*, and a receiving portion 57*c*. The urging piece 57*a* is connected to the base body 56, and urges the contact piece 57 toward the center conductor. The slide retention portion 57*b* extends from the urging piece 57*a* so as to slidably retain the above-described center conductor 17. The receiving portion 57*c* extends from the slide retention portion 57*b* and is opened upward.

The connection terminal 55 is formed by disposing one pair of such connection pieces 55*a*, having the above-described structure, so as to face each other. Each of the connection pieces 55*a* is fixed to the printed-wiring board 50 by inserting fixing claws 54, extending downward from the base body 56, into through holes, formed on the printed-wiring board 50, and by welding the fixing claws 54.

When the input terminal 5 is mounted on the lower case 32, the center conductor 17 is moved toward the printed-wiring board 50 while expanding the receiving portions 57*c* outward (see FIG. 4B). When the terminal-side connection device 20 of the input terminal 5 is suitably mounted on the case-side connection device 30 of the lower case 32, the center conductor 17 is properly stored between the slide retention portions 57*b*.

The contact piece 57, urged by the urging pieces 57*a*, suitably maintains the contact with the center conductor 17. Since the center conductor 17 is formed, as described above, into a pin-shape having a circular cross-section in, at least, the distal end portion thereof, suitable contact with the connection terminal 55 can be maintained even if the center conductor 17 is rotated.

<Effect>

The following describes with regard to attaching the series unit 1, and gives detailed explanation concerning the effect of the series unit 1.

Figure 5:
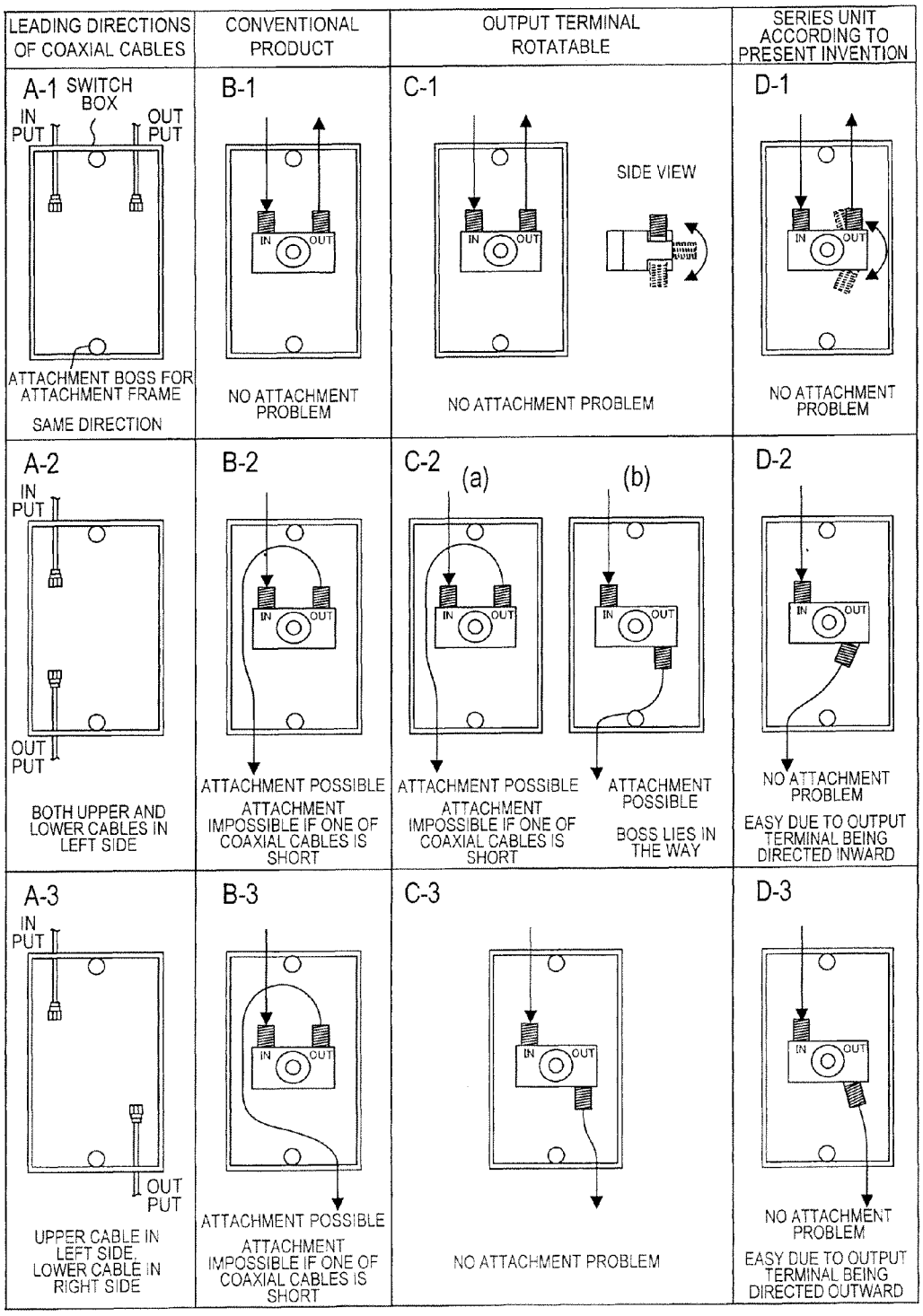
FIG. 5 is a schematic view showing wiring states so as to install series units into switch boxes.

FIG. 5 is a schematic explanatory view illustrating the states of the wiring for attaching a series unit to a switch box. Particularly, A-1 to A-3 of FIG. 5 show the states wherein direct-mounted type series unit, which are previously installed, are removed, the distal end portion of each lead-in wire is reprocessed, and then a coaxial cable connector is attached to the distal end portion. B-1 to B-3 of FIG. 5 show the wiring states of a conventional coaxial receptacle type series unit (to be referred to as Conventional Product 1), which is configured such that the input terminal and the output terminal respectively project upward. C-1 to C-3 of FIG. 5 show the wiring states of a conventional coaxial receptacle type series unit (to be referred to as Conventional Product 2), wherein the input terminal is secured so as to project upward and only the output terminal can be rotated in the same manner as the input terminal 5 of the series unit 1 according to the present invention. D-1 to D-3 of FIG. 5 show the wiring states of the series unit 1 according to the present invention.

A-1, B-1, C-1, and D-1 of FIG. 5 show a case wherein the lead-in wire in the input side and the lead-in wire in the output side are led in the same direction. A-2, B-2, C-2, and D-2 of FIG. 5 show a case wherein the lead-in wire in the input side and the lead-in wire in the output side are led from the upward and downward directions so as to be along the same axis line. A-3, B-3, C-3, and D-3 of FIG. 5 show a case wherein the lead-in wire in the input side and the lead-in wire in the output side are led from the upward and downward directions on different axis lines.

The conditions of the experiment are: the length of the lead-in wire in the input side is 7 cm; the length of the lead-in wire in the output side is 8 cm; and each of the coaxial cables is prepared by connecting a coaxial cable connector to the distal end portion of S5CFB.

First, the attachability of Conventional Product 1 is evaluated. In a case wherein the lead-in wires are lead in the same direction as shown in B-1 of FIG. 5, there is no problem in the attachability. In a case wherein, as shown in B-2, B-3 of FIG. 5, the lead-in wires are introduced so as to be along the same axis line or introduced from the upward and downward directions from different positions, attachment is possible only under the condition wherein one of the coaxial cables needs to be long.

Next, the attachability of Conventional Product 2 is evaluated. In a case wherein the lead-in wires are lead in the same direction as shown in C-1 of FIG. 5, there is no problem in the attachability. In a case wherein the lead-in wires are introduced from the upward and downward directions so as to be along the same axis line as shown in C-2 of FIG. 5, although attachment is possible if the output terminal is directed upward and the lead-in wire is diverted as shown in (a), attachment becomes possible only under the condition wherein one of the coaxial cable needs to be long. If the output terminal is rotated to the downside as shown in (b), connecting the connector becomes easy. However, when the series unit is stored, the coaxial cable might contact an attachment boss for attaching an attachment frame, and the series unit might not be able to be stored. Even if the series unit can be stored, the cable needs to be sharply bent, which causes excessive force, and the force is applied to the connection/disconnection end portion of the connector connected to the distal end of the lead-in wire. Therefore, a problem of liability rises. In a case wherein the lead-in wires are introduced from the upward and downward directions on different axis lines as shown in C-3 of FIG. 5, there is no problem for attachment.

Next, the attachability is evaluated with regard to the series unit 1 according to the present embodiment. In a case wherein the lead-in wires are lead in the same direction, as shown in D-1 of FIG. 5, there is no problem in the attachability as well as in the conventional products. In a case wherein the lead-in wires are introduced from the upward and downward directions so as to be along the same axis line as shown in D-2 of FIG. 5, if the output terminal is rotated so as to be directed downward, when the series unit is stored, the output terminal is inclined from the downward direction further to the inward direction (in the series unit 1, approximately 20° further to the inward direction from the downward direction). Consequently, the output terminal projects toward the direction of the inlet for the lead-in wire introduced from downward, and the coaxial cable does not contact the boss. Therefore, the lead-in wire done not have to be sharply bent, and no excessive force is applied to the connection/disconnection end portion of the connector connected to the distal end of the lead-in wire. As a result, in addition to efficient attachment, highly reliable wiring in terms of connection becomes possible. In a case wherein the lead-in wires are introduced from the upward and the downward directions on different axis lines as shown in D-3 of FIG. 5, the output terminal is moved toward the direction of the inlet for the lead-in wire introduced from downward. Thus, the lead-in wire does not particularly have to be disposed approximately into an S-shape, which can further improve the connectivity.

As described above, the series unit 1 is configured such that, when the series unit 1 is stored into a switch box, the rotational surface of the input terminal 5 is perpendicular to the open surface of the switch box, and the input terminal 5 is rotated upward and downward toward the rear bottom surface of the switch box. Moreover, the series unit 1 is configured such that the rotational surface of the output terminal 8 becomes parallel to the open surface of the switch box. Furthermore, the series unit 1 is configured such that the rotational range of the output terminal 8 becomes equal to or larger than ±90° (±110° in the present embodiment) while the horizontal direction indicates 0°.

Therefore, the series unit 1 always enables wiring to be performed within the minimum bend radius of a coaxial cable, regardless of the direction from which lead-in wires are introduced into a switch box. Moreover, the connecting operation becomes easy, which enables to shorten the operation time.

In addition, the series unit 1 is remarkably useful particularly for renewing a direct-mounted type of series unit with a coaxial receptacle type of series unit.

That is, in order to attach coaxial cable connectors to the distal ends of lead-in wires after removing a direct-mounted type of series unit, processed portion of the lead-in wires need to be cut. Thus, after attaching the connectors, the length of the lead-in wires extending inside a switch box becomes shorter than the original length.

If the series unit 1 is used, the connectivity is not lost even if lead-in wires are short, due to the rotation of the input terminal 5 and the output terminal 8 and to the wide rotational range of the output terminal 8.

A preferable example of renewal work by using the series unit 1 according to the present embodiment will be specifically explained. Digital terrestrial broadcasting using the UHF band has been started, and analog terrestrial broadcasting is supposed to end in July 2011. In an attempt to receive the digital terrestrial broadcasting, if, for example, a direct-mounted type of series unit is used in an existing television reception system, some problems are likely to be caused: external electric wave interference enters from the directly mounted portions, that is the connection/disconnection end portions of coaxial cables connected to the series unit. This causes block-noise, which is particular in digital broadcasting, or cuts off the screen image in some extreme cases. The reception systems using direct-mounted type of series units are required to be replaced as soon as possible so as to be able to receive digital terrestrial broadcasting. If the series unit according to the present invention is used for the renewal work, replacement can be done quickly, easily, and inexpensively in any type of reception system so as to be able to receive digital terrestrial broadcasting.

Second Embodiment

The following describes a second embodiment according to the present invention.

Figure 6A:
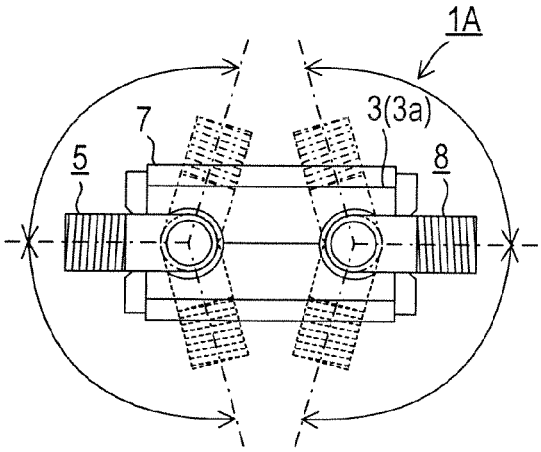
FIGS. 6A-6D are schematic views showing a series unit according to a second embodiment of the present invention.
Figure 6C:
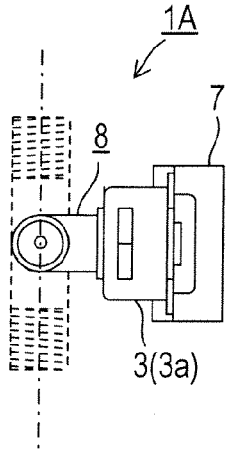
Figure 6B:
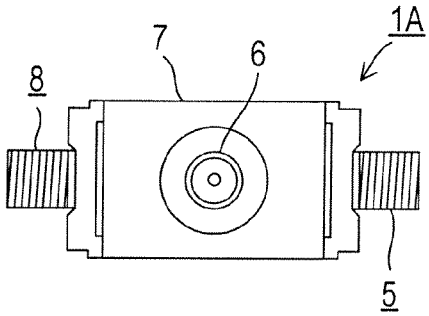
Figure 6D:
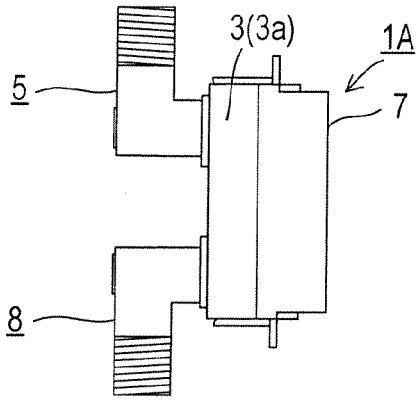

FIGS. 6A-6D are schematic views showing a series unit 1A according to the present embodiment; FIG. 6A is a rear view, FIG. 6B is a front view, FIG. 6C is a side view, and FIG. 6D is a top view thereof.

Since the structure of the series unit 1A is only partially different from the structure of the series unit 1, the difference will be mainly described.

As shown in FIGS. 6A-6D, the series unit 1A includes the unit case 3 constituted only with the first case portion 3*a* without the second case portion 3*b*.

The input terminal 5 is rotatably supported, in the same manner as the output terminal 8, on the rear surface of the unit case 3, and disposed such that the rotational surface of the input terminal 5 becomes in parallel to the rear surface of the unit case 3.

In the series unit 1A configured as above, only the rotational direction of the input terminal 5 is different from in the series unit 1 according to the first embodiment, but the same effect as in the series unit 1 can be achieved.

It is to be noted that one of the input terminal 5 and the output terminal 8 may be unrotatably fixed.

Third Embodiment

The following describes a third embodiment according to the present invention.

Figure 7A:
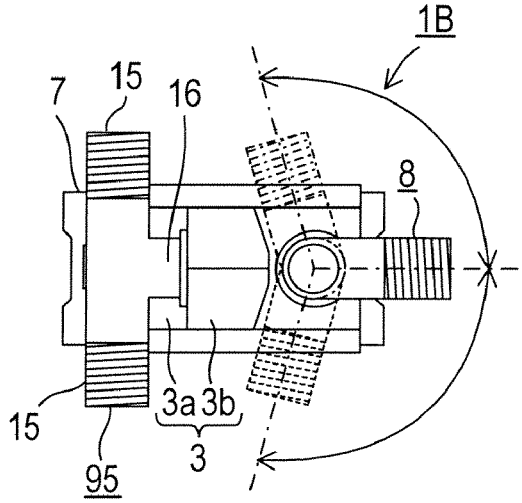
FIGS. 7A-7D are schematic views showing a series unit according to a third embodiment of the present invention.
Figure 7C:
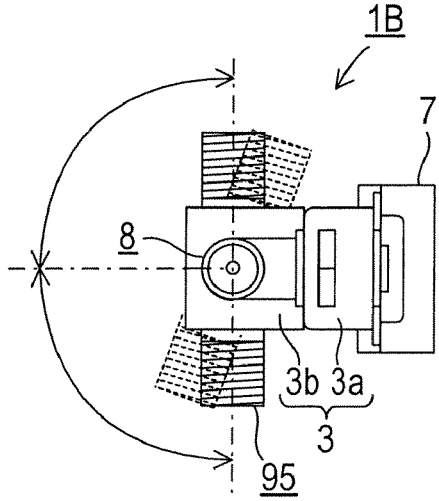
Figure 7B:
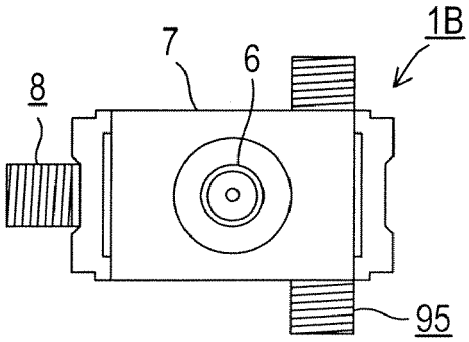
Figure 7D:
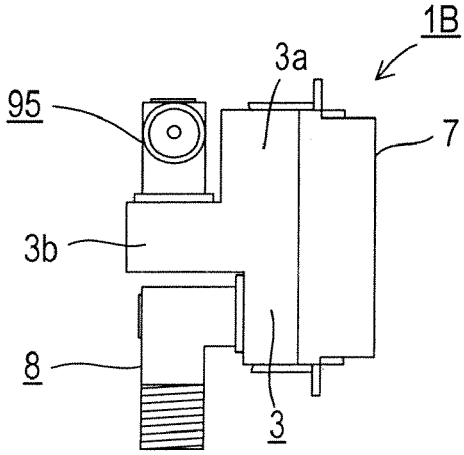
Figure 8A:
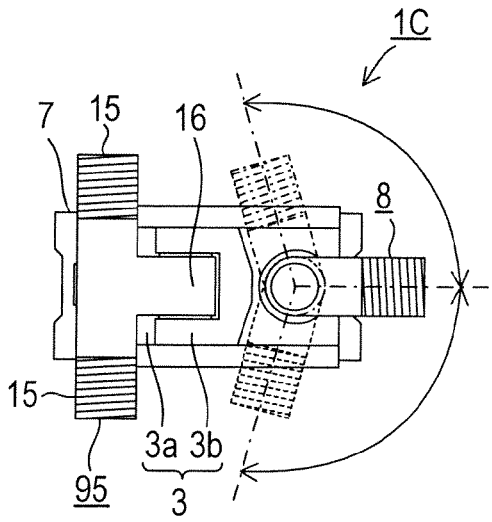
FIGS. 8A-8D are schematic views showing a series unit according to a variation of the third embodiment.
Figure 8C:
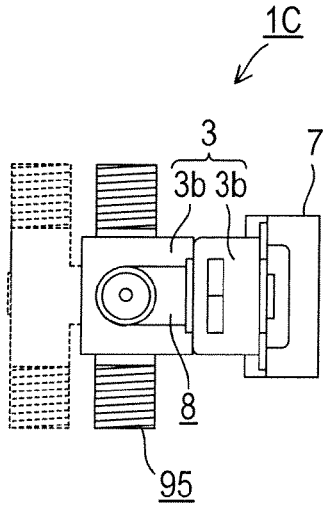
Figure 8B:
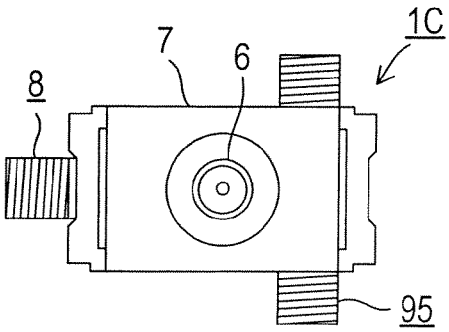
Figure 8D:
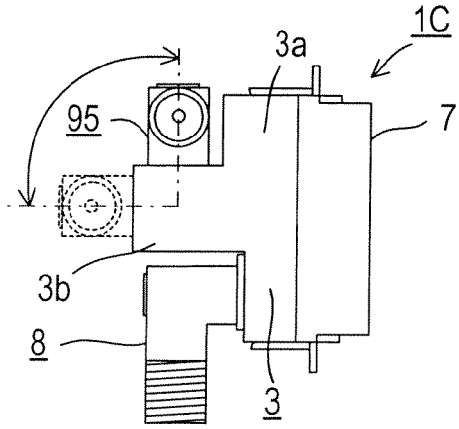

FIGS. 7A-7D are schematic views showing a series unit 1B according to the present embodiment; FIG. 7A is a rear view, FIG. 7B is a front view, FIG. 7C is a side view, and FIG. 7D is a top view thereof.

Since the structure of the series unit 1B is only partially different from the structure of the series unit 1, the difference will be mainly described.

As shown in FIGS. 7A-7D, the series unit 1B is configured in the same manner as the series unit 1, except that the series unit 1B includes, instead of the input terminal 5, a two-pronged terminal 95 having two connection portions (connection/disconnection end portions) 15, connected to external conductors of F-type plugs, and having an outer form in a T-shape.

One end of the two-pronged terminal 95 is used for input, and another end is used for output.

In the series unit 1B configured as above, although the movable range of the two-pronged terminal 95 is limited as compared to the movable range of the input terminal 5 of the series unit 1, the same effect as in the series unit 1 can be achieved.

Since the series unit 1B has two terminals for output, more various types of reception systems can be flexibly constructed.

In the present embodiment, the two-pronged terminal 95 is attached to the unit case 3 so as to be rotated on the central axis of the connection end portion 16 as the rotational axis. Alternatively, as shown in a series unit 1C in FIGS. 8A-8D, the two-pronged terminal 95 may be attached so as to be rotated on the axis, which is perpendicular to the rotational axis of the connection end portion 16 and extends along the central axis of the connection/disconnection end portions 15, as the rotational axis. Moreover, the two-pronged terminal 95 may be unrotatably fixed.

Fourth Embodiment

The following described a fourth embodiment according to the present invention.

A series unit 1D according to the present embodiment has the same outer shape as in the first embodiment. Only the structure of the portion of the input terminal 5 (also the output terminal 8) rotatably attached to the unit case 3 is partially different from the structure in the first embodiment. The difference will be mainly explained.

Figure 9A:
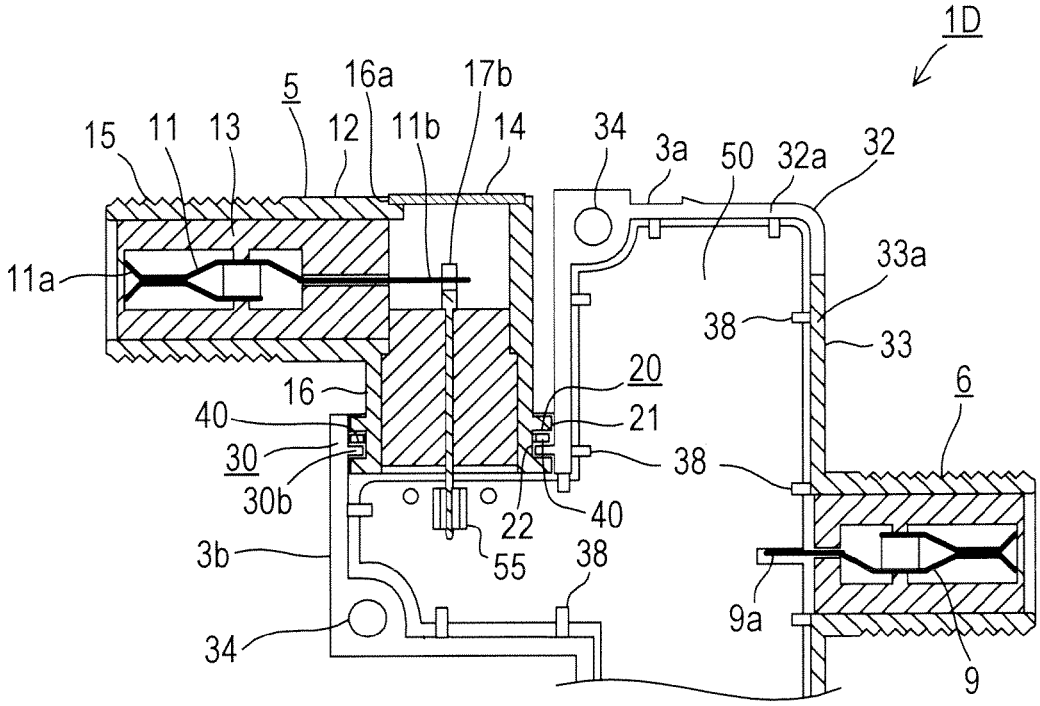
FIGS. 9A-9C are explanatory views showing a series unit according to a fourth embodiment of the present invention.
Figure 9B:
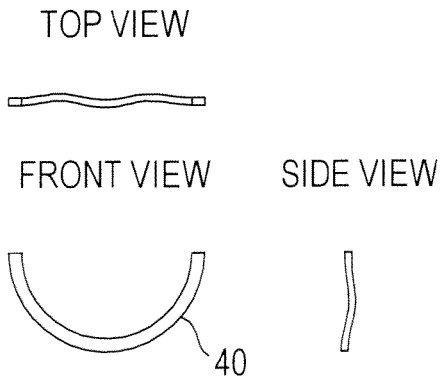
Figure 9C:
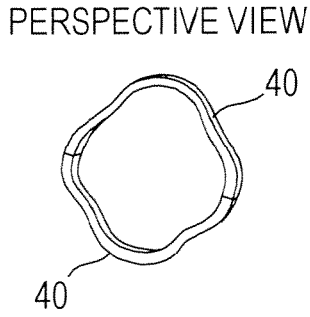

FIG. 9A is a sectional view showing the series unit 1D (corresponding to the sectional view along the line IIIA-IIIA in FIG. 1A). FIG. 9B is a schematic view illustrating a slide member. FIG. 9C is a perspective view showing two of the slide members put together.

As shown in FIG. 9A, a slide member 40, made of a elastic conductive material, is inserted in one side or both sides (only in outer side in the drawing) between the ring-shaped walls 30*b* and the sides of the groove portion 22.

The slide member 40 is configured, as shown in FIG. 9B, by corrugating a semi-circular elastic metallic material.

When the input terminal 5 is attached to the concave portions 30*a* of the upper case 31 and the lower case 32, the slide member 40 is interposed by the groove portion 22, constituting the terminal-side connection device 20, together with the ring-shaped wall 30*b*, constituting the case-side connection device 30. In an assembled state of the unit case 3, wherein one slide member 40 is engaged in each case 31, 32, the slide members 40 are put together, as shown in FIG. 9C, from the upside and the downside so as to be approximately in a circular shape, and attached between the outer side of the ring-shaped wall 30*b* and the side of the groove portion 22.

In the series unit 1D configured as above according to the present embodiment, due to the slide members 40, the input terminal 5 and the output terminal 8 can be smoothly rotated. Moreover, the electrical contact between the input terminal 5 and the unit case 3 and between the output terminal 8 and the unit case 3 is improve, which, in turn, can enhance the shielding property.

Fifth Embodiment

The following describes a fifth embodiment according to the present invention.

Figure 11:
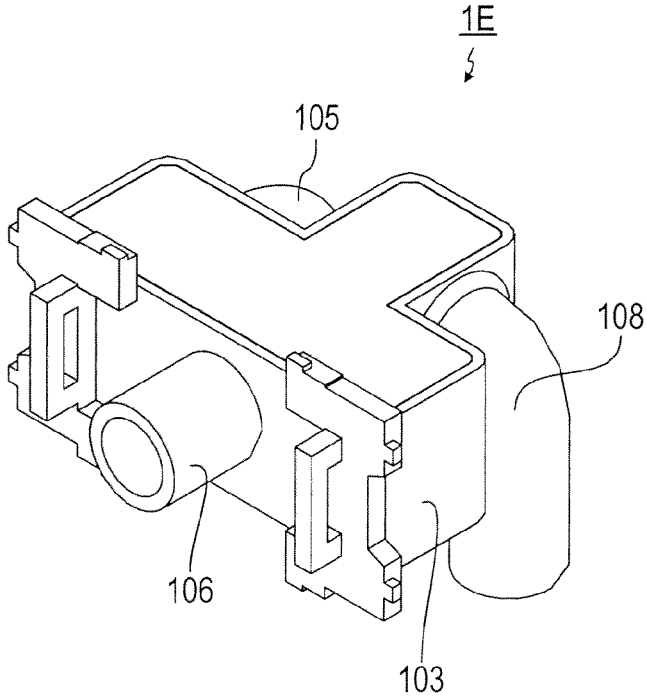
FIG. 11 is a perspective view showing a series unit according to a fifth embodiment of the present invention in a state wherein the terminal block is removed.

FIG. 11 is a perspective view showing a series unit 1E in a state wherein the terminal block 7 is removed.

As shown in FIG. 11, the series unit 1E according to the present embodiment is configured in the same manner as in the first embodiment in terms of the outer shape of the unit case 103, disposition of the input terminal 105, the output terminal 108, and the television terminal 106, and the structure of the television terminal 106.

However, the divisional structure of a unit case 103, the structure of the input terminal 105 and the output terminal 108, and the structure how the terminals 105, 108 are rotatably attached to the unit case 103 are different from the first embodiment. The following mainly explains the difference.

<Structure of Input Terminal and Output Terminal>

Figure 12A:
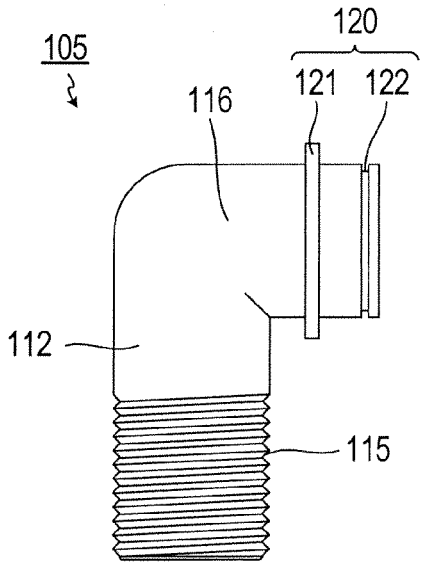
FIG. 12A is a side view showing an input terminal and an output terminal shown in FIG. 11 in an enlarged manner.
Figure 12B:
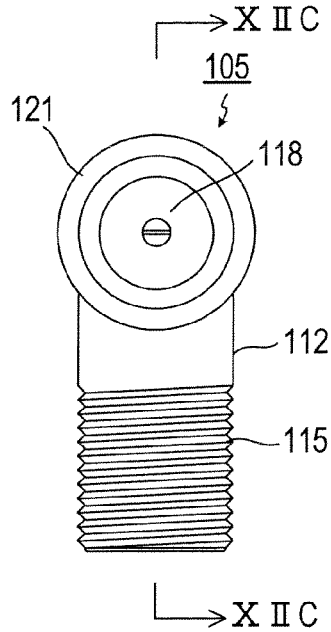
FIG. 12B is a front view thereof.
Figure 12C:
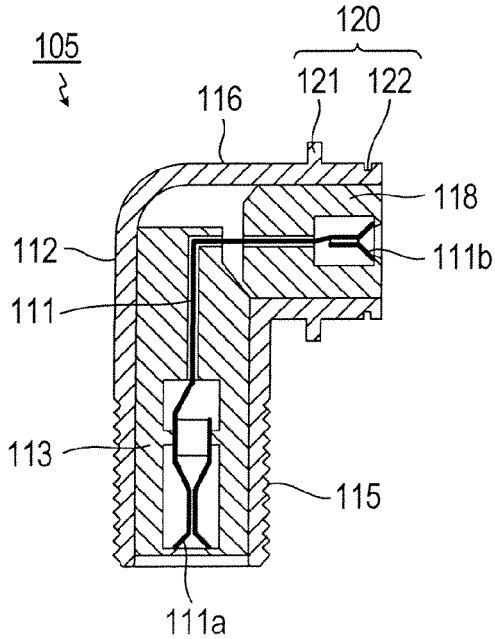
FIG. 12C is a sectional view thereof along the line XIIC-XIIC in FIG. 12B.

FIG. 12A is a side view showing the input terminal 105 and output terminal 108 shown in FIG. 11 in an enlarged manner, and FIG. 12B is a front view thereof. FIG. 12C is a sectional view showing the terminal along the line XIIC-XIIC in FIG. 12B.

In order to simplify the explanation, the following gives the description with regard to the input terminal 105. The description of the output terminal 108, which is configured in the same manner, is not repeated.

As shown in FIGS. 12A-12C, the input terminal 105 is constituted with an F-type receptacle, having an outer form in an L-shape, and including a center conductor 111 and an external conductor 112. The center conductor 111 is connected in an L-shape manner. The external conductor 112 is disposed concentrically with respect to the center conductor 111 (that is, formed in a cylindrical manner having a circular cross-section). In the following, between the two portions of the input terminal 105 forming an L-shape, the portion disposed in the side where the unit case 103 is attached is referred to as a connection end portion 116, and the portion disposed in the side where an F-type plug is connected/disconnected is referred to as a connection/disconnection end portion 115.

The outer peripheral surface of the external conductor 112 in the connection/disconnection end portion 115 is threaded. On the other hand, on the outer peripheral surface of the external conductor 112 in the connection end portion 116, a terminal-side connection device 120 is formed so as to be rotatably attached, while maintaining electrical connection with the unit case 103, to a case-side connection device (shown by the numerical reference 130 in FIG. 13), which is formed on the unit case 103, and will be explained later.

The terminal-side connection device 120 includes a flange portion 121 and a groove portion 122. The flange portion 121 is formed so as to extend along the entire circumference of the external conductor 112 in the connection end portion 116. The groove portion 122 is formed so as to extend along the entire circumference in the distal end side of the connection end portion 116 beyond the flange portion 121.

The center conductor 111 is manufactured by bending a thin-plate metallic material, and provided, on both ends thereof, with receiving portions 111*a*, 111*b* having spring elasticity for receiving the central axes of coaxial cables, or contact pins formed so as to have a circular section.

Two portions of the center conductor 111, which are linearly formed and constitute an L-shape, are respectively held by insulators 113, 118 so as to be disposed in the positions of the central axes of the connection/disconnection end portion 115 and the connection end portion 116.

The insulators 113, 118 are secured and adhered in the inside of the external conductor 112 by known press fitting, adhesive agent, and so on. In order to assemble the center conductor 111 and the insulators 113, 118 with the external conductor 112, the center conductor 111 can be resiliently bent and inserted into the external conductor 112.

<Structure of Unit Case>

As shown in FIG. 11, the unit case 103 includes a first case portion 103*a* and a second case portion 103*b* in the same manner as the unit case 3 according to the first embodiment. The first case portion 103*a* is provided in the front side. The second case portion 103*b* is provided so as to extend rearward from the rear surface of the first case portion 103*a*, and has a size in the horizontal direction shorter than that of the first case portion 103*a*. The first case portion 103*a* and the second case portion 103*b* are configured so as to form a continuous internal space.

Figure 13:
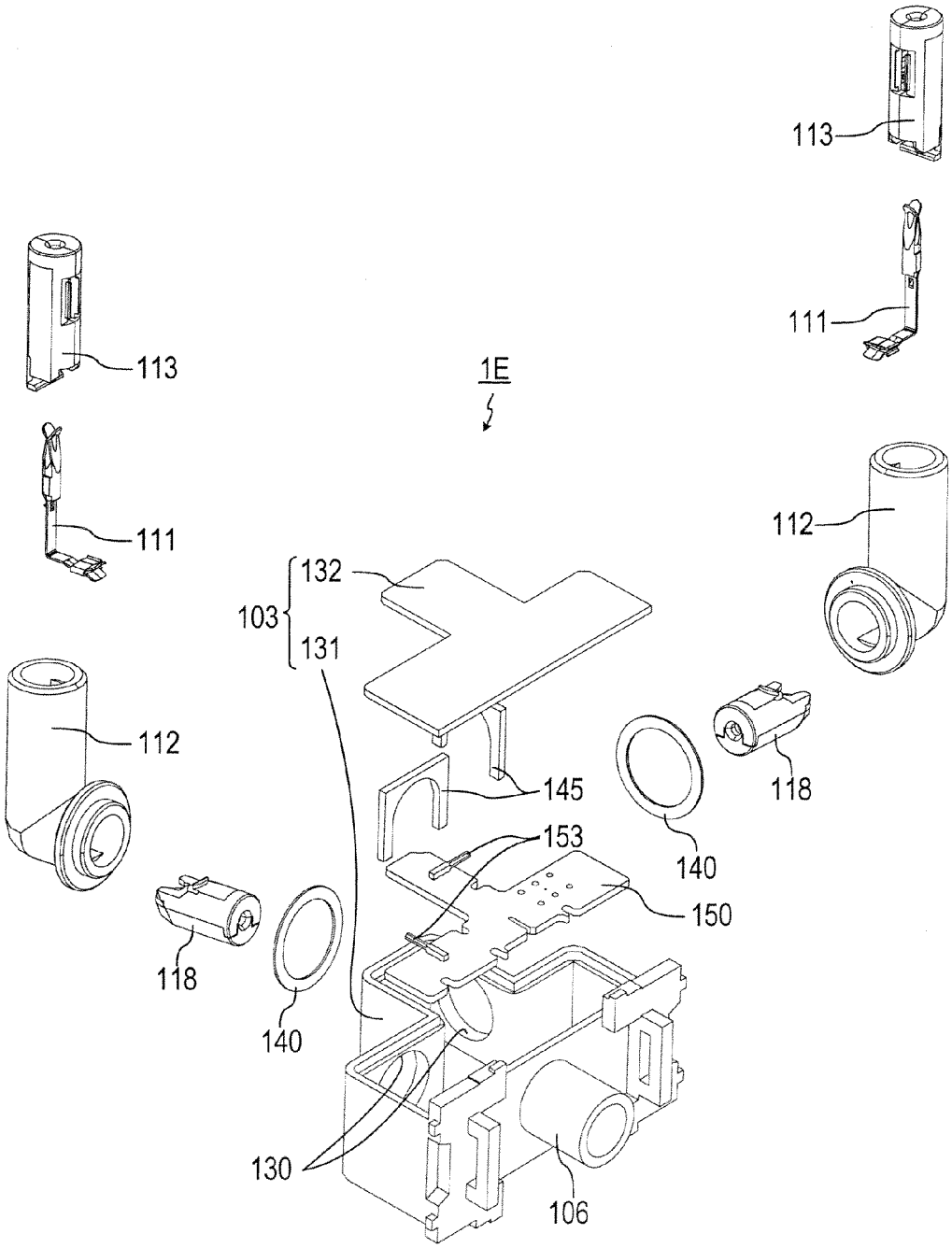
FIG. 13 is a perspective view showing the series unit according to the fifth embodiment in a disassembled manner.

FIG. 13 is a perspective view showing the series unit 1E in a disassembled state.

As shown in FIG. 13, the unit case 103 includes a box-like case 131, and a cover 132, and is formed by integrally fixing the box-like case 131 and the cover 132. The box-like case 131 has an opening on the top side thereof, and stores a printed-wiring board 150 inside thereof. The cover 132 closes the opening of the box-like case 131.

The box-like case 131 is provided, as the case-side connection device, with attachment holes 130, formed by cutting the box-like case 131 into circular shapes, in the attachment positions of the input terminal 105 and the output terminal 108.

The printed-wiring board 150 is provided with connection pins 153, connected to the receiving portions 111*b* of the input terminal 105 and the output terminal 108. The connection pins 153 are disposed so as to pass through the centers of the attachment holes 130, when the printed-wiring board 150 is stored in the box-like case 131. The connection pins 153 are connected to signal-side conductors, formed on the printed-wiring board 150, by welding and the like.

<Attaching Input Terminal and Output Terminal>

Figure 14A:
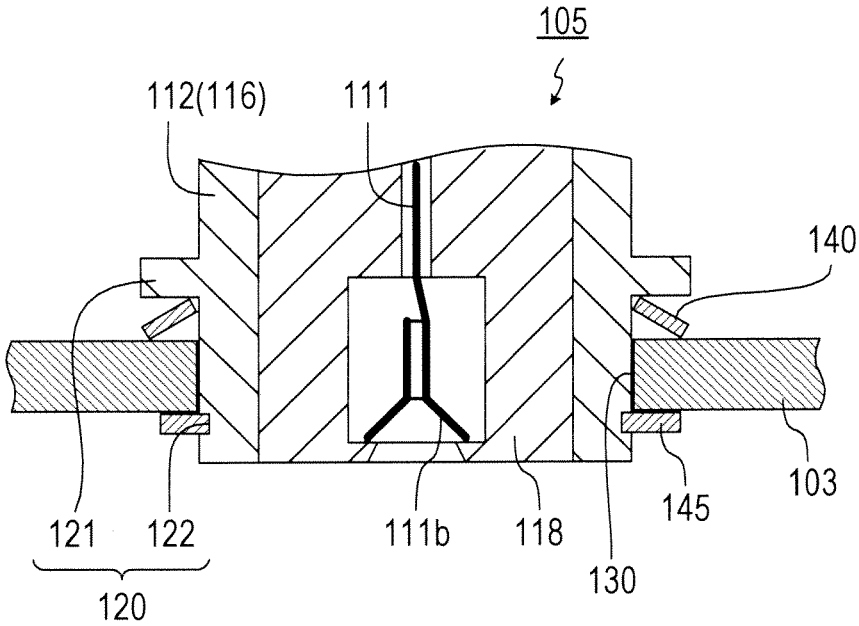
FIG. 14A is a sectional view showing a structure in vicinity of an attachment hole for rotatably attaching an input terminal.

FIG. 14A is a sectional view showing the structure in the vicinity of the attachment hole 130 for rotatably attaching the input terminal 105.

As shown in FIG. 14A, the portion of the input terminal 105, which is provided in the distal end side of the flange portion 121 formed in the connection end portion 116, is inserted into the attachment hole 130. The input terminal 105 is rotatably attached to the attachment hole 130 by a disc spring washer 140, disposed between the outer surface of the box-like case 131 and the flange portion 121, and a stopper piece (for example, E-type retaining ring) 145, attached to the groove portion 122 in the inside of the box-like case 131.

Figure 15A:
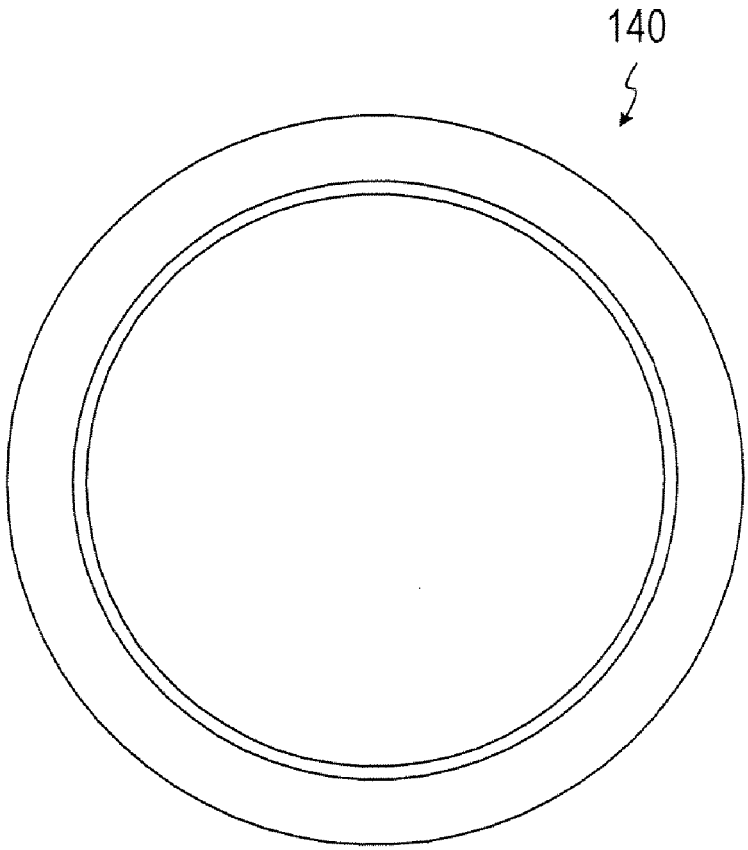
FIG. 15A is a plan view showing a planer shape of a disc spring washer.
Figure 15B:
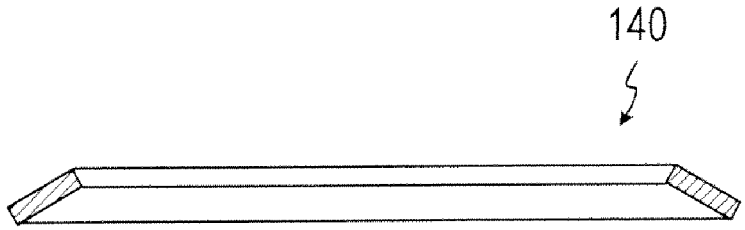
FIG. 15B is a sectional view showing the cross-sectional shape of the disc spring washer.

The disc spring washer 140 is a known component having a planar shape shown in FIG. 15A, and a cross-sectional shape shown in FIG. 15B. The output terminal 108 is rotatably attached to the attachment hole 130 in the same manner.

<Effect>

As described above, the series unit 1E is provided with the disc spring washers 140, which provides line contact to contact portions in which the input terminal 105 and the output terminal 108 contact with the unit case 103 (to be referred to as rotatably attached portions).

Therefore, the series unit 1E can more reliably inhibit ingress of electromagnetic wave into the unit case 103 from the rotatably attached portions, as compared to a case wherein the slide members 40, which provide point contact to contact portions, are used in the rotatably attached portions. As a result, immunity can be further improved. Moreover, since uniform elasticity can be achieved in the entire circumferences of the rotatably attached portions, the input terminal 105 and the output terminal 108 can be smoothly and easily rotated.

Figure 14B:
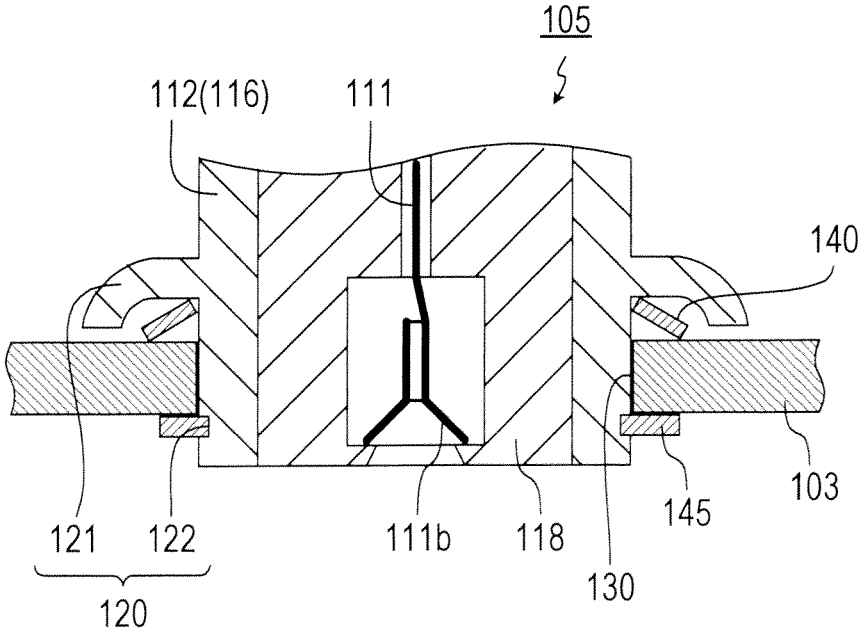
FIG. 14B is a sectional view showing the structure according to a variation.

In the present embodiment, the flange portion 121 is linearly configured so as to be in parallel to the outer surface of the unit case 103. Alternatively, as shown in FIG. 14B, the distal end portion of the flange portion 121 may be bent toward the groove portion 122, and configured in a shape so as to form a pouch-like space together with the outer surface of the unit case 103. In this case, the gap between the flange portion 121 and the outer surface of the unit case 103 can be smaller by the disc spring washers 140, and, therefore, the immunity of the series unit 1E can be further more improved.

It is to be noted that the structure of the unit case 103, the input terminal 105, and the output terminal 108, and the structure for rotatably attaching the input terminal 105, and the output terminal 108, which are explained in the present embodiment, may be applied not only to the series unit 1 according to the first embodiment, but also to the series units 1A-1C according to the second to third embodiments.

Sixth Embodiment

The following describes a sixth embodiment according to the present invention.

A series unit 1F according to the present embodiment is partially different in the structure from the series unit 1E according to the fourth embodiment. The difference will be mainly explained.

<Overall Structure>

Figure 16:
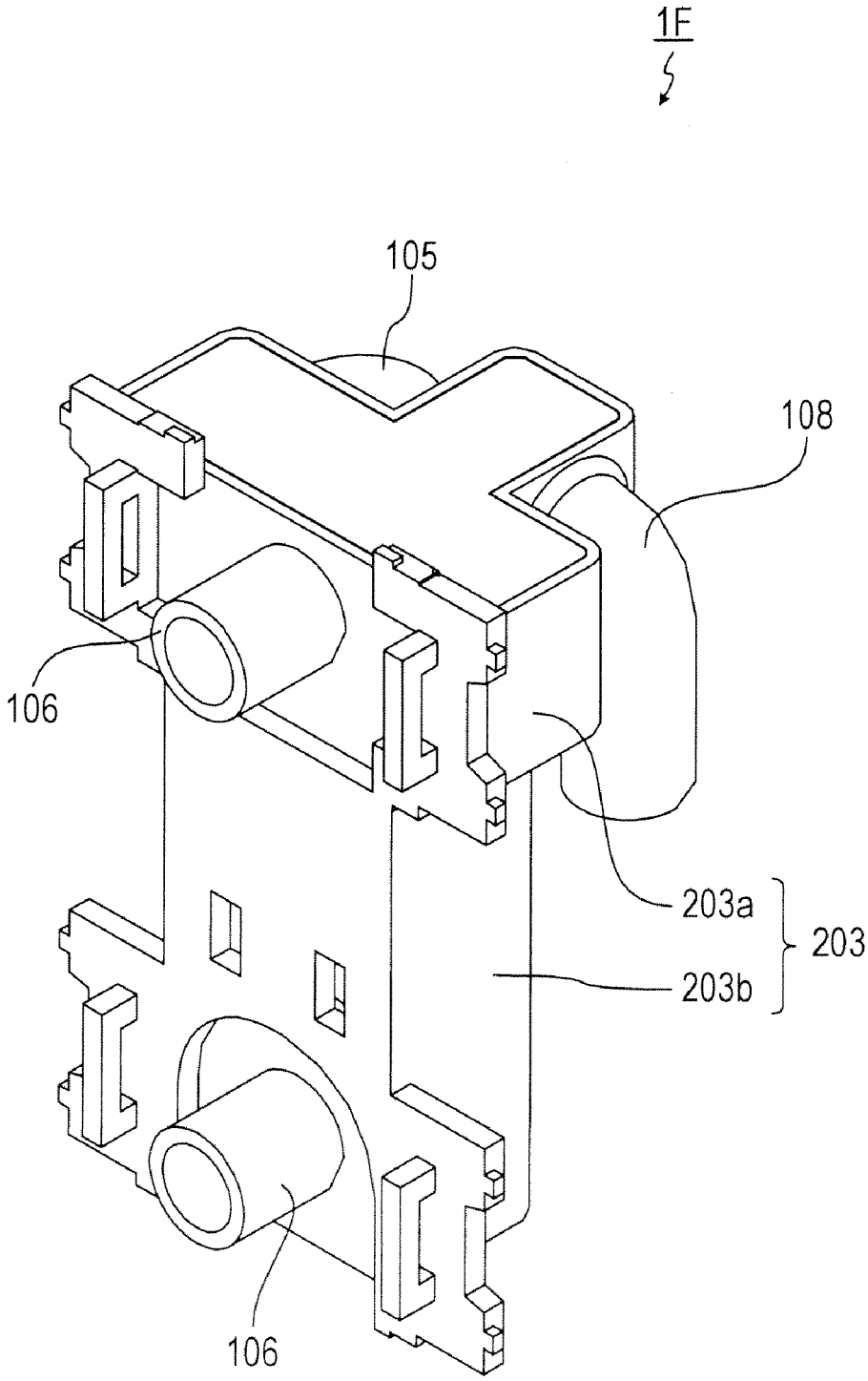
FIG. 16 is a perspective view showing a series unit according to a sixth embodiment of the present invention in a state wherein a terminal block is removed.
Figure 17:
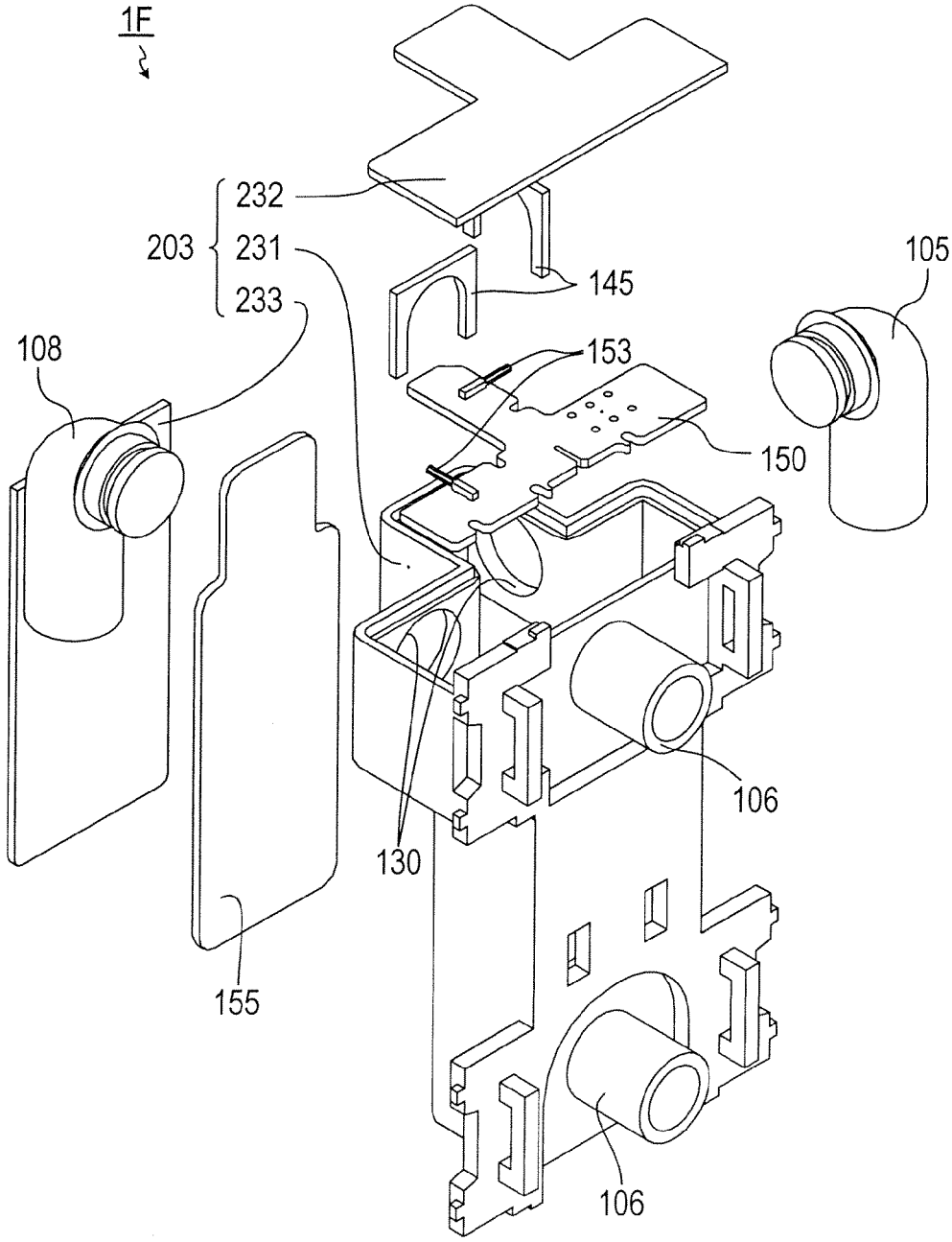
FIG. 17 is a perspective view showing the series unit according to the sixth embodiment in a disassembled state.

FIG. 16 is a perspective view showing the series unit 1F. FIG. 17 is a perspective view showing the series unit 1F in a disassembled state. Both drawings are presented in a state wherein the terminal block 7 is removed. In FIG. 17, for easier understanding of the drawing, the figures of the input terminal 105 and the output terminal 18 are simplified, and the disc spring washers 140, used for rotatably attaching the input terminal 105 and the output terminal 108, are not shown.

As shown in FIGS. 16, 17, the series unit 1F includes two television terminals 106.

That is, signals, inputted from the input terminal 105, are triply split, and outputted from the output terminal 108 and the two television terminals 106.

A unit case 203, in which the terminals 105, 106, and 108 are disposed, stores a first printed-wiring board 150, and includes a first case portion 203*a* and a second case portion 203*b*. The first case portion 203*a* has the same outer shape as in the unit case 103 according to the sixth embodiment. The second case portion 203*b* extends under the first case portion 203*a*, and stores a second printed-wiring board 155. The first case portion 203*a* and the second case portion 203*b* are configured so as to form a continuous internal space.

<Structure of Unit Case>

The unit case 203 includes a box-like case 231, and covers 232, 233, and is formed by integrally fixing the box-like case 231 and the covers 232, 233. The box-like case 231 has openings on the top side of the first case portion 203*a* and the rear side of the second case portion 203*b* so that the printed-wiring boards 150, 155 can be stored therefrom. The covers 232, 233 respectively close the openings.

The first printed-wiring board 150 is configured in the same manner as the printed-wiring board 150 according to the sixth embodiment, expect that the first printed-wiring board 150 includes a connection terminal (not shown) used for connection with the second printed-wiring board 155. To the second printed-wiring board 155, the center conductor of the lower television terminal is secured by welding and the like. The second printed-wiring board 155 includes a connection terminal (not shown) which is welded to the connection terminal of the first printed-wiring board 150.

The structure and the rotatable attachment structure of the input terminal 105 and the output terminal 108 are the same as in the sixth embodiment. Therefore, the description thereof is not repeated here.

<Effect>

As described above, since the series unit 1F is configured in the same manner as the series unit 1E according to the sixth embodiment, except that the series unit 1F is provided with two television terminals 106, in addition to achieving the same effect as in the series unit 1E, the series unit 1F can be suitably used in a case wherein many television terminals 106 need to be provided.

Other Embodiment

It is to be noted that the present invention is not limited to the above-described embodiments, but can be carried out by arbitrarily altering the components in respective portions as described below.

For example, in the respective embodiments described above, the configuration may be such that the input terminals 5, 105 and the output terminals 8, 108 are changed over.

Moreover, the output terminals 8, 108 are not indispensable, but may be omitted. However, in that case, the input terminals 5, 105 need to be configured such that the rotational surfaces thereof are perpendicular to the central axes of the television terminals 6, 106.

Furthermore, three or more television terminals 6, 106 may be provided.

Still furthermore, instead of the input terminal 105 according to the fifth and the sixth embodiments, the two-pronged terminal 95 described in the third embodiment may be used.

Moreover, in the fifth and the sixth embodiments, the inserting position of the disc spring washer 140 is not limited to the position between the flange portion 121 and the outer wall surface of the unit case 103 (or 203), but may be a position between the inner wall surface of the unit case 103 (or 203) and the stopper piece 145. Furthermore, in the fourth to the sixth embodiments, although the slide member 40, formed by corrugating a semicircular elastic metallic material, or the disc spring washer 140 is inserted into the rotatably attached portions of the input terminals 5, 105 and the output terminals 8, 108, other types of washers may be inserted.

What is claimed is:

1. A series unit comprising:

an input terminal, an output terminal, and a television terminal each constituted with a tubular receptacle having a center conductor and an external conductor provided concentrically with the center conductor; and a unit case that supports the input terminal, the output terminal and the television terminal, the external conductors of the terminals being electrically interconnected through the unit case, the center conductors of the terminals being electrically interconnected in a space formed inside of the unit case, both of the input terminal and the output terminal having a shape in which a direction of a connection end portion, connected to the unit case, and a direction of a connection/disconnection end portion, to/from which a terminal of a cable is connected/disconnected, are perpendicular to each other, being constituted as movable terminals so as to be rotatable at the connection end portions connected to the unit case, and being disposed such that planes defined by central axes of the connection/disconnection end portions by rotation of the movable terminals intersect with each other, wherein the unit case includes:

a first case portion having a front surface to which the television terminal is provided; and a second case portion provided to a portion on a rear surface of the first case portion so as to extend therefrom, and having an internal space connected to a space formed inside of the first case portion, and wherein one of the input terminal and the output terminal is disposed on the rear surface of the first case portion, and another is disposed on a lateral surface of the second case extending from the rear surface of the first case portion.

2. The series unit according to claim 1, wherein one of the movable terminals is disposed such that the plane, defined by the central axis of the connection/disconnection end portion by rotation of the one of the movable end terminals, is perpendicular to a central axis of the television terminal.

3. The series unit according to claim 1, wherein a rotational range of the movable terminal is larger than 180°.

4. The series unit according to claim 1, wherein the connection/disconnection end portion of the movable terminal is constituted with an F-type conductor which allows a connection of an F-type plug, connected to a distal end of a coaxial cable.

5. A series comprising:

a connection terminal, an output terminal, and a television terminal each constituted with a tubular receptacle having a center conductor and an external conductor provided concentrically with the center conductor; and a unit case that supports the connection terminal, the output terminal and the television terminal, the external conductors of the terminals being electrically interconnected through the unit case, the center conductors of the terminals being electrically interconnected in a space formed inside of the unit case, both of the connection terminal and the output terminal having a shape in which a direction of a connection end portion, connected to the unit case, and a direction of a connection/disconnection end portion, to/from which a terminal of a cable is connected/disconnected, are perpendicular to each other, being constituted as movable terminals so as to be rotatable at the connection end portions connected to the unit case, and being disposed such that planes defined by central axes of the connection/disconnection end portions by rotation of the movable terminals intersect with each other, wherein the connection terminal is embodied in a two-pronged terminal, and the two-pronged terminal includes:

a connection end portion connected to the unit case; and a pair of connection/disconnection end portions to/from which terminals of cables are connected/disconnected, one of the connection/disconnection end portions being used for input and another being used for output.

6. The series unit according to claim 5, wherein one of the movable terminals is disposed such that the plane, defined by the central axis of the connection/disconnection end portion by rotation of the one of the movable end terminals, is perpendicular to a central axis of the television terminal.

7. The series unit according to claim 5, wherein a rotational range of the movable terminal is larger than 180°.

8. The series unit according to claim 5, wherein the connection/disconnection end portion of the movable terminal is constituted with an F-type conductor which allows a connection of an F-type plug, connected to a distal end of a coaxial cable.

9. A series unit comprising:

an input terminal, an output terminal, and a television terminal each constituted with a tubular receptacle having a center conductor and an external conductor provided concentrically with the center conductor; and a unit case that supports the input terminal, the output terminal and the television terminal, the external conductors of the terminals being electrically interconnected through the unit case, the center conductors of the terminals being electrically interconnected in a space formed inside of the unit case, both of the input terminal and the output terminal having a shape in which a direction of a connection end portion, connected to the unit case, and a direction of a connection/disconnection end portion, to/from which a terminal of a cable is connected/disconnected, are perpendicular to each other, being constituted as movable terminals so as to be rotatable at the connection end portions connected to the unit case, and being disposed such that planes defined by central axes of the connection/disconnection end portions by rotation of the movable terminals intersect with each other, wherein the connection end portion of the movable terminal is rotatably attached to an attachment hole, formed on the unit case, and configured such that the external conductor maintains electrical connection with the unit case, and that the movable terminal is rotated on a central axis of the connection end portion as a rotational axis, wherein the unit case is constituted with a pair of divided cases by integrally securing the pair of divided cases, each of the pair of divided cases being formed so as to a have a half of the attachment hole thereon, wherein one of an outer peripheral surface of the connection end portion of the movable terminal and an attachment hole forming fringe, forming the attachment hole of the divided cases, is provided with a groove portion, and another is provided with a convex portion, engaged with the groove portion, as a terminal-side connection device and a case-side connection device, and wherein the movable terminal is rotatably attached to the unit case by sandwiching the terminal-side connection device with the case-side connection device provided to each of the pair of divided cases.

10. The series unit according to claim 9, wherein one of the movable terminals is disposed such that the plane, defined by the central axis of the connection/disconnection end portion by rotation of the one of the movable end terminals, is perpendicular to a central axis of the television terminal.

11. The series unit according to claim 9, wherein a rotational range of the movable terminal is larger than 180°.

12. The series unit according to claim 9, wherein the connection/disconnection end portion of the movable terminal is constituted with an F-type conductor which allows a connection of an F-type plug, connected to a distal end of a coaxial cable.

13. A series unit comprising:

an input terminal, an output terminal, and a television terminal each constituted with a tubular receptacle having a center conductor and an external conductor provided concentrically with the center conductor; and a unit case that supports the input terminal, the output terminal and the television terminal, the external conductors of the terminals being electrically interconnected through the unit case, the center conductors of the terminals being electrically interconnected in a space formed inside of the unit case, both of the input terminal and the output terminal having a shape in which a direction of a connection end portion, connected to the unit case, and a direction of a connection/disconnection end portion, to/from which a terminal of a cable is connected/disconnected, are perpendicular to each other, being constituted as movable terminals so as to be rotatable at the connection end portions connected to the unit case, and being disposed such that planes defined by central axes of the connection/disconnection end portions by rotation of the movable terminals intersect with each other, wherein the connection end portion of the movable terminal is rotatably attached to an attachment hole, formed on the unit case, and configured such that the external conductor maintains electrical connection with the unit case, and that the movable terminal is rotated on a central axis of the connection end portion as a rotational axis, wherein the connection end portion of the movable terminal comprises:

an insertion portion adopted to be inserted through an attachment hole;

a flange portion formed so as to have a diameter larger than a diameter of the attachment hole; and a groove portion formed in a position on an outer peripheral surface of the insertion portion, and in a position away from the flange portion for, at least, as long as a thickness of a portion of a wall surface of the unit case where the attachment hole is formed, and wherein the movable terminal is rotatably attached to the unit case by securing a stopper piece, having a diameter of the attachment hole, while the insertion portion is inserted through the attachment hole.

14. The series unit according to claim 13, wherein one of the movable terminals is disposed such that the plane, defined by the central axis of the connection/disconnection end portion by rotation of the one of the movable end terminals, is perpendicular to a central axis of the television terminal.

15. The series unit according to claim 13, wherein a rotational range of the movable terminal is larger than 180°.

16. The series unit according to claim 13, wherein the connection/disconnection end portion of the movable terminal is constituted with an F-type conductor which allows a connection of an F-type plug, connected to a distal end of a coaxial cable.

17. A series unit comprising:

an input terminal, an output terminal, and a television terminal each constituted with a tubular receptacle having a center conductor and an external conductor provided concentrically with the center conductor; and a unit case that supports the input terminal, the output terminal and the television terminal, the external conductors of the terminals being electrically interconnected through the unit case, the center conductors of the terminals being electrically interconnected in a space formed inside of the unit case, at least one of the input terminal and the output terminal having a shape in which a direction of a connection end portion, connected to the unit case, and a direction of a connection/disconnection end portion, to/from which a terminal of a cable is connected/disconnected, are perpendicular to each other, being constituted as a movable terminal so as to be rotatable at the connection end portion connected to the unit case, and being disposed such that a plane defined by a central axis of the connection/disconnection end portion by rotation of the movable terminal is perpendicular to a central axis of the television terminal, wherein the unit case includes:

a first case portion having a front surface to which the television terminal is provided; and a second case portion provided to a portion on a rear surface of the first case portion so as to extend therefrom, and having an internal space connected to a space formed inside of the first case portion, and wherein one of the input terminal and the output terminal is disposed on the rear surface of the first case portion, and another is disposed on a lateral surface of the second case extending from the rear surface of the first case portion.

18. A series unit comprising:

a connection terminal, and a television terminal each constituted with a tubular receptacle having a center conductor and an external conductor provided concentrically with the center conductor; and a unit case that supports the connection terminal and the television terminal, the external conductors of the terminals being electrically interconnected through the unit case, the center conductors of the terminals being electrically interconnected in a space formed inside of the unit case, the connection terminal having a shape in which a direction of a connection end portion, connected to the unit case, and a direction of a connection/disconnection end portion, to/from which a terminal of a cable is connected/disconnected, are perpendicular to each other, being constituted as a movable terminal so as to be rotatable at the connection end portion connected to the unit case, and being disposed such that a plane defined by a central axis of the connection/disconnection end portion by rotation of the movable terminal is perpendicular to a central axis of the television terminal, wherein the connection terminal is embodied in a two-pronged terminal, and the two-pronged terminal includes:

a connection end portion connected to the unit case; and a pair of connection/disconnection end portion to/from which terminals of cables are connected/disconnected, one of the connection/disconnection end portions being used for input and another being used for output.

19. The series unit according to claim 18, wherein a rotational range of the movable terminal is larger than 180°.

20. The series unit according to claim 18, wherein the connection/disconnection end portion of the movable terminal is constituted with an F-type conductor which allows a connection of an F-type plug, connected to a distal end of a coaxial cable.

21. The series unit according to claim 18, wherein the connection end portion of the movable terminal is rotatably attached to an attachment hole, formed on the unit case, and configured such that the external conductor maintains electrical connection with the unit case, and that the movable terminal is rotated on a central axis of the connection end portion as a rotational axis.

22. A series unit comprising:

an input terminal, and a television terminal each constituted with a tubular receptacle having a center conductor and an external conductor provided concentrically with the center conductor; and a unit case that supports the input terminal and the television terminal, the external conductors of the terminals being electrically interconnected through the unit case, the center conductors of the terminals being electrically interconnected in a space formed inside of the unit case, the input terminal having a shape in which a direction of a connection end portion, connected to the unit case, and a direction of a connection/disconnection end portion, to/from which a terminal of a cable is connected/disconnected, are perpendicular to each other, being constituted as a movable terminal so as to be rotatable at the connection end portion connected to the unit case, and being disposed such that a plane defined by a central axis of the connection/disconnection end portion by rotation of the movable terminal is perpendicular to a central axis of the television terminal, wherein the connection end portion of the movable terminal is rotatably attached to an attachment hole, formed on the unit case, and configured such that the external conductor maintains electrical connection with the unit case, and that the movable terminal is rotated on a central axis of the connection end portion as a rotational axis, wherein the unit case is constituted with a pair of divided cases by integrally securing the pair of divided cases, each of the pair of divided cases being formed so as to a have a half of the attachment hole thereon, wherein one of an outer peripheral surface of the connection end portion of the movable terminal and an attachment hole forming fringe, forming the attachment hole of the divided cases, is provided with a groove portion, and another is provided with a convex portion, engaged with the groove portion, as a terminal-side connection device and a case-side connection device, and wherein the movable terminal is rotatably attached to the unit case by sandwiching the terminal-side connection device with the case-side connection device provided to each of the pair of divided cases.

23. A series unit comprising:

an input terminal, and a television terminal each constituted with a tubular receptacle having a center conductor and an external conductor provided concentrically with the center conductor; and a unit case that supports the input terminal and the television terminal, the external conductors of the terminals being electrically interconnected through the unit case, the center conductors of the terminals being electrically interconnected in a space formed inside of the unit case, the input terminal having a shape in which a direction of a connection end portion, connected to the unit case, and a direction of a connection/disconnection end portion, to/from which a terminal of a cable is connected/disconnected, are perpendicular to each other, being constituted as a movable terminal so as to be rotatable at the connection end portion connected to the unit case, and being disposed such that a plane defined by a central axis of the connection/disconnection end portion by rotation of the movable terminal is perpendicular to a central axis of the television terminal, wherein the connection end portion of the movable terminal is rotatably attached to an attachment hole, formed on the unit case, and configured such that the external conductor maintains electrical connection with the unit case, and that the movable terminal is rotated on a central axis of the connection end portion as a rotational axis, wherein the connection end portion of the movable terminal comprises:

an insertion portion adopted to be inserted through an attachment hole;

a flange portion formed so as to have a diameter larger than a diameter of the attachment hole; and a groove portion formed in a position on an outer peripheral surface of the insertion portion, and in a position away from the flange portion for, at least, as long as a thickness of a portion of a wall surface of the unit case where the attachment hole is formed, and wherein the movable terminal is rotatably attached to the unit case by securing a stopper piece, having a diameter of the attachment hole, while the insertion portion is inserted through the attachment hole.

* * * * *